US007470211B2

(12) United States Patent
Ueura et al.

(10) Patent No.: US 7,470,211 B2
(45) Date of Patent: Dec. 30, 2008

(54) VARIABLE VALVE SYSTEM OF INTERNAL COMBUSTION ENGINE AND CONTROL METHOD THEREOF

(75) Inventors: Hibiki Ueura, Toyota (JP); Naohide Fuwa, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 174 days.

(21) Appl. No.: 11/218,590

(22) Filed: Sep. 6, 2005

(65) Prior Publication Data

US 2006/0052216 A1 Mar. 9, 2006

(30) Foreign Application Priority Data

Sep. 9, 2004 (JP) ..... 2004-262764

(51) Int. Cl.

| | |
|---|---|
| ***F02N 3/00*** | (2006.01) |
| ***F02B 41/00*** | (2006.01) |
| ***F02B 67/00*** | (2006.01) |
| ***F16H 59/60*** | (2006.01) |
| ***F16H 59/62*** | (2006.01) |
| ***F16H 59/00*** | (2006.01) |

(52) U.S. Cl. ..... 477/97; 477/98; 123/188.9; 123/198 C

(58) Field of Classification Search ..... 477/97; 123/41.02, 188.9, 198 C

See application file for complete search history.

(56) References Cited

U.S. PATENT DOCUMENTS

| | | | | |
|---|---|---|---|---|
| 3,134,371 | A * | 5/1964 | Crooks | 123/41.31 |
| 6,739,305 | B2 * | 5/2004 | Takahara et al. | 123/196 R |
| 6,904,875 | B2 * | 6/2005 | Kilger | 123/41.1 |
| 6,913,326 | B1 * | 7/2005 | Ohkubo et al. | 303/11 |
| 2002/0023604 | A1 | 2/2002 | Nohara et al. | |

FOREIGN PATENT DOCUMENTS

| | | | |
|---|---|---|---|
| DE | 10142260 | A1 | 4/2002 |
| JP | 03-199633 | A | 8/1991 |
| JP | 04-132414 | U | 8/1992 |
| JP | 04-284107 | A | 10/1992 |
| JP | 10-227235 | A | 8/1998 |
| JP | A 2001-263015 | | 9/2001 |
| JP | 2002-256829 | A | 9/2002 |
| JP | 2003322032 | A | * 11/2003 |
| JP | 2004-068809 | A | 3/2004 |
| JP | 2005-233174 | A | 9/2005 |

* cited by examiner

*Primary Examiner*—Tisha D Lewis
(74) *Attorney, Agent, or Firm*—Kenyon & Kenyon LLP

(57) ABSTRACT

A valve characteristic changing mechanism is supplied with oil discharged from an electric oil pump in addition to oil discharged from a mechanical oil pump that is driven by an operation of an internal combustion engine. Driving of the electric oil pump is controlled such that a work rate of the electric oil pump increases as a temperature of the oil supplied to the valve characteristic changing mechanism increases, or as a viscosity of the oil is reduced.

17 Claims, 13 Drawing Sheets

VARIABLE VALVE SYSTEM OF INTERNAL COMBUSTION ENGINE AND CONTROL METHOD THEREOF

INCORPORATION BY REFERENCE

The disclosure of Japanese Patent Application No. 2004-262764 filed on Sep. 9, 2004 including the specification, drawings and abstract is incorporated herein by reference in its entirety.

BACKGROUND OF THE INVENTION

1. Field of the Invention

The invention relates to a variable valve system of an internal combustion engine, and a control method thereof.

2. Description of the Related Art

In an internal combustion engine such as an engine for an automobile, a valve characteristic of an engine valve, for example, an intake valve is changed based on an engine operating state with the aim of optimizing an output from the engine and fuel efficiency in the entire engine operating region. Japanese Patent Application Publication No. 2001-263015 A discloses a valve characteristic changing mechanism which changes a valve characteristic. This valve characteristic changing mechanism is driven by a hydraulic pressure of oil discharged from a mechanical oil pump that is driven by an operation of an engine. The valve characteristic of the engine valve is adjusted to a target characteristic, which is set so as to be variable based on the engine operating state, by driving the above-mentioned valve characteristic changing mechanism, whereby the valve characteristic is made suitable for the present engine operation.

As a temperature of the oil for operating the valve characteristic changing mechanism increases, a viscosity of the oil is reduced, resulting in an increase in an amount of oil leaking from the valve characteristic changing mechanism and an oil supply passage through which oil is supplied to the valve characteristic changing mechanism. As such an oil leakage increases, the hydraulic pressure of the oil supplied to the valve characteristic changing mechanism decreases by a larger amount, and a response of the valve characteristic changing mechanism is likely to be delayed. Accordingly, for example, if the target characteristic is changed based on the engine operating state while the oil temperature is high, an adjustment-speed characteristic that adjusts an actual valve characteristic to the target characteristic may deteriorate.

SUMMARY OF THE INVENTION

The invention is made in light of the above-mentioned circumstances. It is, therefore, an object of the invention to provide a variable valve system of an internal combustion engine, which can suppress deterioration of an adjustment-speed characteristic that adjusts an actual valve characteristic to a target characteristic, and a control method thereof.

According to a first aspect of the invention, there is provided a variable valve system of an internal combustion engine, including a mechanical oil pump which is driven by an operation of an internal combustion engine; a valve characteristic changing mechanism which is driven by a hydraulic pressure of oil discharged from the mechanical oil pump, thereby changing a valve characteristic of an engine valve; an electric oil pump which discharges oil for driving the valve characteristic changing mechanism; and a controller which controls the valve characteristic changing mechanism such that the valve characteristic of the engine valve is adjusted to a target characteristic that is set based on an engine operating state. The controller drives the electric oil pump such that, as a temperature of the oil supplied to the valve characteristic changing mechanism increases, a hydraulic pressure of the oil discharged from the electric oil pump increases.

According to the first aspect, in addition to the oil discharged from the mechanical oil pump, the oil from the electric oil pump that discharges oil independently of the operation of the internal combustion engine is used to drive the valve characteristic changing mechanism for changing the valve characteristic. As the temperature of the oil supplied to the valve characteristic changing mechanism increases, a viscosity of the oil is reduced, resulting in an increase in an amount of oil leaking from the valve characteristic changing mechanism and an oil supply passage through which oil is supplied to the valve characteristic changing mechanism. As a result, the hydraulic pressure of the oil supplied to the valve characteristic changing mechanism decreases by a larger amount, and a response of the valve characteristic changing mechanism is likely to be delayed. However, according to the first aspect, the electric oil pump is driven such that, as the temperature of the oil supplied to the valve characteristic changing mechanism increases, the hydraulic pressure of the oil discharged from the electric oil pump increases. As a result, a decrease in the hydraulic pressure of the oil supplied to the valve characteristic changing mechanism is suppressed, and a delay in response of the valve characteristic changing mechanism is suppressed. It is, therefore, possible to reduce a possibility that the adjustment-speed characteristic that adjusts the actual valve characteristic to the variable target characteristic deteriorates as the temperature of the oil increases.

The temperature of the oil may be obtained, for example, by using an oil temperature sensor, or by making an estimate based on, for example, a temperature of a coolant for the internal combustion engine. Accordingly, in the first aspect, the controller may obtain an oil temperature base value based on the temperature of the coolant for the internal combustion engine, calculate a correction value by using a parameter related to a heat balance of the oil supplied to the valve characteristic changing mechanism, and use a value obtained by correcting the oil temperature base value by using the correction value as the temperature of the oil.

Although the temperature of the coolant for the internal combustion engine changes according to the temperature of the oil supplied to the valve characteristic changing mechanism, the coolant temperature and the oil temperature do not always change with the same changing pattern. Accordingly, if the coolant temperature is used, without being corrected, as a value indicating the oil temperature, the value does not accurately indicate the oil temperature. However, according to the above-mentioned aspect, the oil temperature is obtained by using the parameter related to the heat balance of the oil, in addition to the coolant temperature. Therefore, the oil temperature thus obtained can be regarded as an accurate value.

The heat balance of the oil varies depending on the operating state of the internal combustion engine. Accordingly, when the temperature of the oil is obtained based on the coolant temperature, a parameter may be selected from the parameters related to the heat balance of the oil, depending on the operating state of the internal combustion engine. For example, when starting of the internal combustion engine is initiated, a time that elapses from when stopping of the internal combustion engine is completed until when starting of the internal combustion engine is initiated may be used as the parameter. During a period from when cold starting of the internal combustion engine is initiated until when warming of the internal combustion engine is completed, at least one of a time that has elapsed since starting of the internal combustion engine is initiated, and an accumulated value indicating a total amount of air that has been taken in the internal combustion engine since starting of the internal combustion engine is initiated may be used as the parameter. Since the oil temperature base value is corrected by using the correction value that is calculated based on the parameter corresponding to the operating state of the internal combustion engine, the oil temperature that is obtained by the correction can be regarded as an accurate value indicating the oil temperature when starting of the internal combustion engine is initiated.

When the vehicle provided with the internal combustion engine is running at high load and high speed, the controller may calculate the correction value based on the parameter related to the heat balance of the oil and a parameter related to an amount of heat removed from the coolant. In this case, as the parameter related to the heat balance of the oil, at least one of an engine load, a time that has elapsed since running at high load and high speed is started, and an accumulated value which indicates a total amount of air that has been taken in the internal combustion engine since running at high load and high speed is started may be used. As the parameter related to the amount of heat removed from the coolant for the internal combustion engine, at least one of an engine rotational speed and a vehicle speed may be used. Since the oil temperature base value is corrected by using the correction value calculated based on these parameters, the oil temperature obtained by the correction can be regarded as an accurate value indicating the oil temperature when the vehicle starts running at high load and high speed.

According to a second aspect of the invention, there is provided variable valve system of an internal combustion engine, including a mechanical oil pump which is driven by an operation of an internal combustion engine; a valve characteristic changing mechanism which is driven by a hydraulic pressure of oil discharged from the mechanical oil pump, thereby changing a valve characteristic of an engine valve; an electric oil pump which discharges oil for driving the valve characteristic changing mechanism; and a controller which controls the valve characteristic changing mechanism such that the valve characteristic of the engine valve is adjusted to a target characteristic that is set based on an engine operating state. The controller drives the electric oil pump such that, as a viscosity of the oil supplied to the valve characteristic changing mechanism is reduced, a hydraulic pressure of the oil discharged from the electric oil pump increases.

According to the second aspect, in addition to the oil discharged from the mechanical oil pump, the oil from the electric oil pump that discharges oil independently of the operation of the internal combustion engine is used to drive the valve characteristic changing mechanism for changing the valve characteristic. As the temperature of the oil supplied to the valve characteristic changing mechanism increases, the viscosity of the oil is reduced, resulting in an increase in an amount of oil leaking from the valve characteristic changing mechanism and an oil supply passage through which oil is supplied to the valve characteristic changing mechanism. As a result, the hydraulic pressure of the oil supplied to the valve characteristic changing mechanism decreases by a larger amount, and a response of the valve characteristic changing mechanism is likely to be delayed. However, according to the second aspect, the electric oil pump is driven such that, as the viscosity of the oil supplied to the valve characteristic changing mechanism is reduced, the hydraulic pressure of the oil discharged from the electric oil pump increases. As a result, a decrease in the hydraulic pressure of the oil supplied to the valve characteristic changing mechanism is suppressed, and a delay in response of the valve characteristic changing mechanism is suppressed. It is, therefore, possible to reduce a possibility that the adjustment-speed characteristic that adjusts the actual valve characteristic to the variable target characteristic deteriorates as the temperature of the oil increases.

The viscosity of the oil may be detected by, for example, a viscosity sensor.

According to a third aspect of the invention, there is provided a variable valve system of an internal combustion engine, including a mechanical oil pump which is driven by an operation of an internal combustion engine; a valve characteristic changing mechanism which is driven by a hydraulic pressure of oil discharged from the mechanical oil pump, thereby changing a valve characteristic of an engine valve; an electric oil pump which discharges oil for driving the valve characteristic changing mechanism; and a controller which controls the valve characteristic changing mechanism such that the valve characteristic of the engine valve is adjusted to a target characteristic that is set based on an engine operating state. The controller drives the electric oil pump such that, as a difference between the valve characteristic and the target characteristic increases, a hydraulic pressure of the oil discharged from the electric oil pump increases.

According to the third aspect, in addition to the oil discharged from the mechanical oil pump, the oil from the electric oil pump that discharges oil independently of the operation of the internal combustion engine is used to drive the valve characteristic changing mechanism for changing the valve characteristic. As the temperature of the oil supplied to the valve characteristic changing mechanism increases, the viscosity of the oil is reduced, resulting in an increase in an amount of oil leaking from the valve characteristic changing mechanism and an oil supply passage through which oil is supplied to the valve characteristic changing mechanism. As a result, the hydraulic pressure of the oil supplied to the valve characteristic changing mechanism decreases by a larger amount, and a response of the valve characteristic changing mechanism is likely to be delayed. Accordingly, the difference between the actual valve characteristic and the target characteristic is likely to increase. However, according to the third aspect, the electric oil pump is driven such that, as the difference increases, the hydraulic pressure of the oil discharged from the electric oil pump increases. As a result, a decrease in the hydraulic pressure of the oil supplied to the valve characteristic changing mechanism is suppressed, and a delay in response of the valve characteristic changing mechanism is suppressed. It is, therefore, possible to reduce a possibility that the adjustment-speed characteristic that adjusts the actual valve characteristic to the variable target characteristic deteriorates as the temperature of the oil increases.

According to a fourth aspect of the invention, there is provided a variable valve system of an internal combustion engine, including a mechanical oil pump which is driven by an operation of an internal combustion engine; a valve characteristic changing mechanism which is driven by a hydraulic pressure of oil discharged from the mechanical oil pump, thereby changing a valve characteristic of an engine valve; an electric oil pump which discharges oil for driving the valve characteristic changing mechanism; and a controller which controls the valve characteristic changing mechanism such that the valve characteristic of the engine valve is adjusted to a target characteristic that is set so as to be variable based on an engine operating state. The controller drives the electric oil pump, such that, among driving regions of the valve characteristic changing mechanism, in a driving region in which a speed of change in the valve characteristic when the valve characteristic changing mechanism is driven is likely to be higher, a hydraulic pressure of the oil discharged from the electric oil pump is higher.

According to the fourth aspect, in addition to the oil discharged from the mechanical oil pump, the oil from the electric oil pump that discharges oil independently of the operation of the internal combustion engine is used to drive the valve characteristic changing mechanism for changing the valve characteristic. As the temperature of the oil supplied to the valve characteristic changing mechanism increases, the viscosity of the oil is reduced, resulting in an increase in an amount of oil leaking from the valve characteristic changing mechanism and an oil supply passage through which oil is supplied to the valve characteristic changing mechanism. As a result, the hydraulic pressure of the oil supplied to the valve characteristic changing mechanism decreases by a larger amount, and a response of the valve characteristic changing mechanism is likely to be delayed. Among the driving regions of the valve characteristic changing mechanism, in a driving region in which the speed of change in the valve characteristic when the valve characteristic changing mechanism is driven is likely to be higher, the negative effect caused by the delay in response is more significant. In such a driving region, although the target speed at which the valve characteristic is changed to the target characteristic is high and high response is required to achieve the target speed, the response is delayed. However, according to the fourth aspect, the electric oil pump is driven such that, in a driving region in which the speed of change in the valve characteristic when the valve characteristic changing mechanism is driven is likely to be higher, the hydraulic pressure of the oil discharged from the electric oil pump is higher. As a result, a delay in response due to an increase in the oil temperature and the negative effect caused by the delay in response can be reliably suppressed. It is, therefore, possible to reliably suppress deterioration of the adjustment-speed characteristic that adjusts the actual valve characteristic to the variable target characteristic.

In any one of the first to fourth aspects, the controller may drive the electric oil pump such that, when the engine rotational speed becomes lower than a predetermined value that is equal to or lower than an idle speed during an idling operation, the hydraulic pressure of the oil discharged from the electric oil pump decreases.

When the electric oil pump is driven, an electrical load of the internal combustion engine increases by an amount corresponding to the electric power for driving the electric oil pump. Therefore, the engine rotational speed is likely to decrease due to an increase in the electrical load. Accordingly, if the electric oil pump is driven during the idling operation in which the engine rotational speed decreases, engine stalling may be caused due to a decrease in the engine rotational speed. However, with the above-mentioned structure, the electric oil pump is driven such that, when the engine rotational speed becomes lower than the predetermined value that is equal to or lower than the idle speed, the hydraulic pressure of the oil discharged from the electric oil pump decreases. As a result, the electrical load of the internal combustion engine decreases, and occurrence of engine stalling is suppressed.

In any one of the first to fourth aspects, a structure in which an accumulator is connected to an oil supply passage that is connected to the valve characteristic changing mechanism may be employed. With such a structure, when the internal combustion engine is operating relatively stably, for example, when the rotational speed of the internal combustion engine decreases or when the idling operation is performed, the hydraulic pressure of the oil supplied to the valve characteristic changing mechanism is accumulated by the accumulator. When the valve characteristic needs to be changed rapidly, for example, when the rotational speed of the internal combustion engine is decreases, the valve characteristic changing mechanism is driven by using the hydraulic pressure accumulated by the accumulator. Accordingly, when the valve characteristic needs to be changed rapidly, for example, when the rotational speed of the internal combustion engine is increased, the hydraulic pressure of the oil discharged from the electric oil pump, in other words, the work rate of the electric oil pump can be made low while the response of the valve characteristic changing mechanism is maintained at a required level. Since the work rate of the electric oil pump is made low, the electrical load of the internal combustion engine due to driving of the electric oil pump is reduced, and the fuel efficiency of the engine can be improved.

In any one of the first to fourth aspects, the controller may restrict a change in a driving state of the electric oil pump, when a driving state of the valve characteristic changing mechanism changes rapidly.

The speed of change in the valve characteristic varies depending on the driving region of the valve characteristic changing mechanism. A transition of the speed of change in the valve characteristic corresponding to the driving regions varies depending on the hydraulic pressure of the oil discharged from the electric oil pump. Accordingly, for example, in a case where the driving state (driving region) of the valve characteristic changing mechanism is changed rapidly such that the valve characteristic is adjusted to the target characteristic, if the driving state of the electric oil pump is greatly changed, the transition of the speed of change in the valve characteristic considerably changes. Accordingly, it becomes difficult to cause the valve characteristic to appropriately reach the target characteristic. As a result, the target-reaching characteristic that causes the valve characteristic to reach the target characteristic may deteriorate. However, since the change in the driving state of the electric oil pump is restricted when the driving state of the valve characteristic changing mechanism changes rapidly, a considerable change in the transition of the speed of change in the valve characteristic is suppressed. Therefore, the possibility that it becomes difficult to cause the valve characteristic to appropriately reach the target characteristic is reduced. It is, therefore, possible to suppress deterioration of the target-reaching characteristic that causes the valve characteristic to reach the target characteristic.

In any one of the first to fourth aspects, the internal combustion engine may include a lift amount changing mechanism which changes a maximum lift amount of the engine valve; and a valve timing changing mechanism which changes valve timing of the engine valve, as the valve characteristic changing mechanisms.

With the above-mentioned structure, in the internal combustion engine including the lift amount changing mechanism and the valve timing changing mechanism, it is possible to reduce the possibility that the adjustment-speed characteristic that adjusts the actual valve characteristic (actual valve timing) to the variable target characteristic (target valve timing) deteriorates as the temperature of the oil supplied to the valve timing changing mechanism increases.

BRIEF DESCRIPTION OF THE DRAWINGS

The forgoing and further objects, features and advantages of the invention will become apparent from the following description of exemplary embodiments with reference to the accompanying drawings, wherein like numerals are used to represent like elements and wherein.

DETAILED DESCRIPTION OF THE EXEMPLARY EMBODIMENTS

First Embodiment

Hereafter, a first embodiment of the invention will be described with reference to FIGS. 1 to 10. The first embodiment relates to a variable valve system of an in-cylinder injection spark ignition type engine mounted in an automobile.

Figure 1:
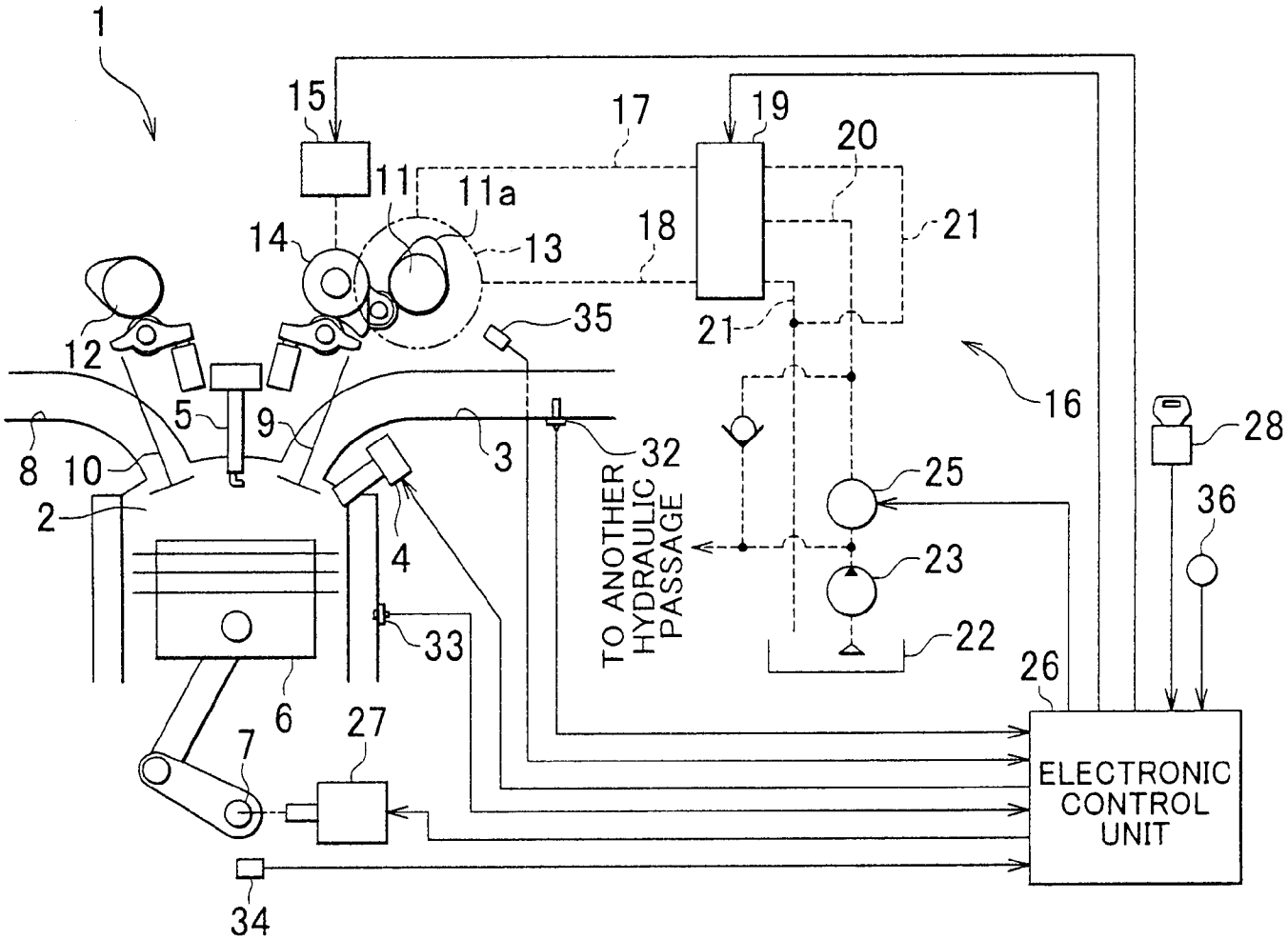
FIG. 1 is a view schematically showing an entire engine to which a variable valve system according to a first embodiment of the invention is applied.

In an engine 1 shown in FIG. 1, air is supplied to a combustion chamber 2 through an intake passage 3, and fuel is directly injected from a fuel injection valve 4. When a spark plug 5 ignites an air-fuel mixture formed of the thus supplied air and fuel, the air-fuel mixture is burned and a piston 6 reciprocates, causing a crankshaft 7 serving as an output shaft of the engine 1 to rotate. The burned air-fuel mixture, that is, exhaust gas, is discharged from the combustion chamber 2 to an exhaust passage 8. A starter 27, which forcibly rotates the crankshaft 7 that has been stopped when the engine 1 is started, is connected to the crankshaft 7.

In the engine 1, communication between the combustion chamber 2 and the intake passage 3 is permitted/interrupted by opening/closing an intake valve 9. Similarly, communication between the combustion chamber 2 and the exhaust passage 8 is permitted/interrupted by opening/closing an exhaust valve 10. The intake valve 9 is opened/closed due to rotation of an inlet cam shaft 11 to which rotation of the crankshaft 7 is transmitted, and the exhaust valve 10 is opened/closed due to rotation of an exhaust cam shaft 12 to which rotation of the crankshaft 7 is transmitted.

The inlet cam shaft 11 is provided with a valve timing changing mechanism 13 which advances/retards valve timing of the intake valve 9 by adjusting a relative rotational phase of the inlet cam shaft 11 with respect to the crankshaft 7. A lift amount changing mechanism 14 which changes a maximum lift amount of intake valve 9 and a working angle of an inlet cam 11*a* that opens/closes the intake valve 9 is provided between the inlet cam shaft 11 and the intake valve 9. Valve characteristics such as the valve timing and the maximum lift amount of intake valve 9 and the working angle of the inlet cam 11*a* are changed by the valve timing changing mechanism 13 and the lift amount changing mechanism 14.

Figure 2:
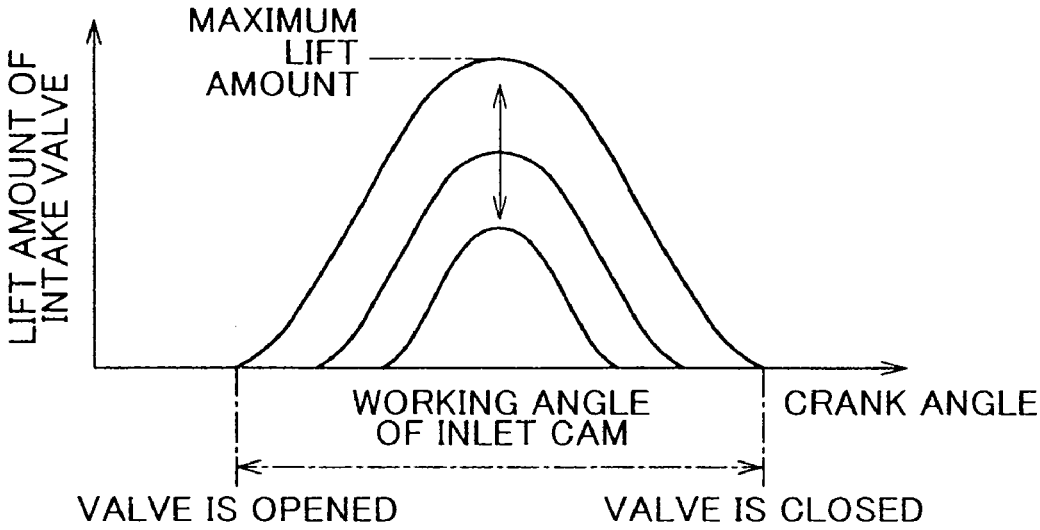
FIG. 2 is a graph showing a change in a maximum lift amount of an intake valve and a change in a working angle of an inlet cam due to driving of a lift amount changing mechanism.

The lift amount changing mechanism 14 is driven by an electric motor 15. FIG. 2 shows a state of change in the maximum lift amount of an intake valve 9 and a change in the working angle of an inlet cam 11*a* due to driving of the lift amount changing mechanism 14. As shown in FIG. 2, the maximum lift amount of intake valve 9 and the working angle of the inlet cam 11*a* are changed in synchronization with each other. For example, as the working angle of the inlet cam 11*a* decreases, the maximum lift amount of the intake valve 9 decreases. As the working angle decreases, the valve opening timing and the valve closing timing of the intake valve 9 come closer to each other, namely, a valve opened period of the intake valve 9 is reduced.

Figure 3:
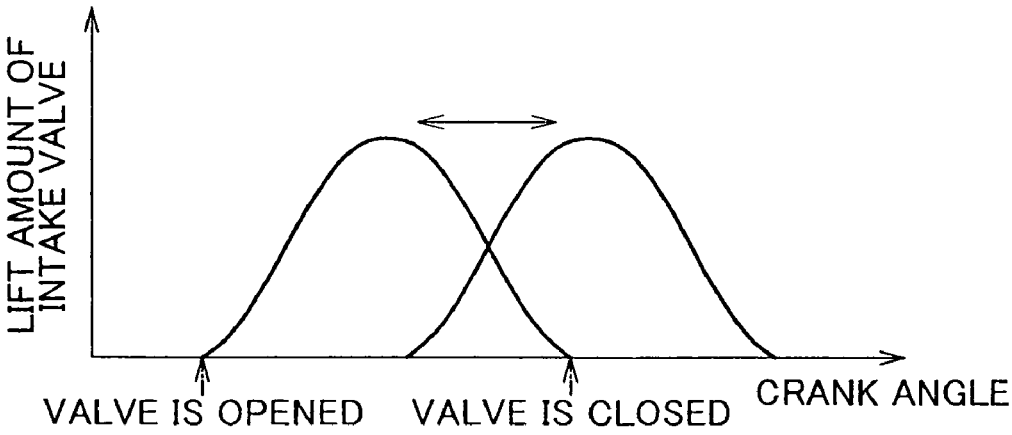
FIG. 3 is a graph showing a change in valve timing of the intake valve due to driving of a valve timing changing mechanism.

Meanwhile, the valve timing changing mechanism 13 shown in FIG. 1 is driven by controlling a hydraulic pressure applied to the valve timing changing mechanism 13 through a hydraulic circuit 16. FIG. 3 shows a state of change in the valve timing of the intake valve 9 due to driving of the valve timing changing mechanism 13. As shown in FIG. 3, when the valve timing of the intake valve 9 is changed, both the valve opening timing and the valve closing timing of the intake valve 9 are advanced or retarded while the valve opened period of the intake valve 9 is maintained at a constant length.

Hereafter, the hydraulic circuit 16 which controls a hydraulic pressure applied to the valve timing changing mechanism 13 will be described in detail with reference to FIG. 1. The hydraulic circuit 16 includes an advanced side oil passage 17 and a retarded side oil passage 18, which are connected to the valve timing changing mechanism 13. The advanced side oil passage 17 and the retarded side oil passage 18 are connected to an oil control valve (hereinafter, referred to as an "OCV") 19, and eventually to an oil pan 22 of the engine 1 through a supply passage 20 and an exhaust passage 21. The supply passage 20 is provided with a mechanical oil pump 23 which is driven by rotation of the crankshaft 7 and discharges oil to the OCV 19. The OCV 19 performs a changing operation by using a force of a coil spring and a force of an electromagnet solenoid, which are applied in opposite directions, thereby changing a state of connection between the supply passage 20 and the exhaust passage 21, and the advanced side oil passage 17 and the retarded side oil passage 18.

When communication is permitted between the retarded side oil passage 18 and the supply passage 20 and communication is permitted between the advanced side oil passage 17 and the exhaust passage 21 through the changing operation performed by the OCV 19, the oil (hydraulic fluid) in the oil pan 22 is supplied to the retarded side oil passage 18 by the mechanical oil pump 23, and the oil (hydraulic fluid) in the advanced side oil passage 17 is returned to the oil pan 22. At this time, oil is supplied to the valve timing changing mechanism 13 through the retarded side oil passage 18. Thus, the valve timing changing mechanism 13 is operated by the hydraulic pressure such that the relative rotational phase of the inlet cam shaft 11 with respect to the crankshaft 7 is retarded. As a result, the valve timing of the intake valve 9 is retarded.

Also, when communication is permitted between the retarded side oil passage 18 and the exhaust passage 21 and communication is permitted between the advanced side oil passage 17 and the supply passage 20 through the changing operation performed by the OCV 19, the oil in the oil pan 22 is supplied to the advanced side oil passage 17 by the mechanical oil pump 23, and the oil in the retarded side oil passage 18 is returned to the oil pan 22. At this time, oil is supplied to the valve timing changing mechanism 13 through the advanced side oil passage 17. Thus, the valve timing changing mechanism 13 is operated by the hydraulic pressure such that the relative rotational phase of the inlet cam shaft 11 with respect to the crankshaft 7 is advanced. As a result, the valve timing of the intake valve 9 is advanced.

As described so far, the valve timing of the intake valve 9 is controlled through the changing operation performed by the OCV 19. The changing operation of the OCV 19 is performed by changing an applied voltage of an electromagnetic solenoid based on a duty ratio command value. The duty ratio command value is changed within a range, for example, "from −50% to 50%". The changing operation is performed by the OCV 19 such that, as the duty ratio command value decreases toward "−50%", the hydraulic pressure applied to the valve timing changing mechanism 13 through the retarded side oil passage 18 increases. Accordingly, a force for retarding the valve timing of the intake valve 9 increases. The changing operation is performed by the OCV 19 such that, as the duty ratio command value increases toward "50%", the hydraulic pressure applied to the valve timing changing mechanism 13 through the advanced side oil passage 17 increases. Accordingly, a force for advancing the valve timing of the intake valve 9 increases.

The valve timing of the intake valve 9 is changed based on the engine operating state through the changing operation performed by the OCV 19 with the aim of optimizing an output from the engine 1 and fuel efficiency in the entire engine operating region. More specifically, the target valve timing is set so as to be variable based on the engine operating state, and the duty ratio command value is calculated such that the actual valve timing is adjusted to the target valve timing. The valve timing is changed by driving the OCV 19 based on the duty ratio command value. Thus, the valve timing of the intake valve 9 is made suitable for the present engine operating state.

When the temperature of the oil for operating the valve timing changing mechanism 13 increases, the viscosity of the oil is reduced, resulting in an increase in an amount of oil leaking from the valve timing changing mechanism 13 and an oil supply passage through which oil is supplied to the valve timing changing mechanism 13. As a result, the hydraulic pressure of the oil supplied to the valve timing changing mechanism 13 decreases, and the response of the valve timing changing mechanism 13 is delayed. In this case, for example, when the target valve timing is changed based on the engine operating state, an adjustment-speed characteristic that adjusts the actual valve timing to the target valve timing deteriorates.

Therefore, in the first embodiment, as the pump which discharges oil to the supply passage 20, there is provided an electric oil pump 25 which is supplied with electric power from a battery of the automobile and an alternator, and which is driven independently of the operation of the engine 1, in addition to the mechanical oil pump 23. The electric oil pump 25 is driven such that, as the temperature of the oil supplied to the valve timing changing mechanism 13 increases, a work rate of the electric oil pump 25 increases, in other words, the hydraulic pressure of the oil discharged from the electric oil pump 25 increases.

Thus, the valve timing changing mechanism 13 is driven by the oil discharged from the electric oil pump 25 in addition to the oil discharged from the mechanical oil pump 23. As a result, a decrease in the hydraulic pressure when the temperature of the oil supplied to the valve timing changing mechanism 13 is high is suppressed, and a delay in response of the valve timing changing mechanism 13 is suppressed. It is, therefore, possible to reduce a possibility that the adjustment-speed characteristic that adjusts the actual valve timing to the variable target valve timing deteriorates as the temperature of the oil increases.

Next, a control system of the variable valve system in the first embodiment will be described. The variable valve system includes an electronic control unit 26 which performs various types of control such as an operation control of the engine 1. The electronic control unit 26 includes a CPU which performs computations concerning the various types of control; ROM which stores programs and data required for the control; RAM which temporarily stores the computation results obtained by the CPU; an input port through which signals from elements outside of the electronic control unit 26 are received; and an output port through which signals to elements outside of the electronic control unit 26 are transmitted.

Various sensors are connected to the input port of the electronic control unit 26. The sensors are (i) an ignition switch 28 with which a driver of the automobile performs an stop operation (OFF operation) and a start operation (ON operation) for the engine 1, and which transmits a signal indicating the operation performed by the driver to the electronic control unit 26; (ii) an air flow meter 32 which detects an amount of air taken in the combustion chamber 2 through the intake passage 3; (iii) a coolant sensor 33 which detects a temperature of a coolant for the engine 1, that is, a temperature of a coolant which is circulated by a water pump driven by an operation of the engine 1; (iv) a crank position sensor 34 which outputs a signal corresponding to the rotation of the crankshaft 7, and which is used for calculating an engine rotational speed and the like; (v) a cam position sensor 35 which outputs a signal indicating a rotational position of the cam; and (vi) a vehicle speed sensor 36 which detects a vehicle speed of the automobile.

The output port of the electronic control unit 26 is connected to drive circuits of the fuel injection valve 4, the electric motor 15, the OCV 1.9, the electric oil pump 25, and the starter 27.

The electronic control unit 26 obtains the engine operating state based on the signals received from the above-mentioned sensors, and outputs command signals to the drive circuits connected to the output port based on the obtained engine operating state. Thus, the electronic control unit 26 controls the amount of fuel injected from the fuel injection valve 4; the valve timing of the intake valve 9; the maximum lift amount of the intake valve 9; the working angle of the inlet cam 1*a*; driving of the electric oil pump 25; and driving of the starter 27.

Next, drive control of the electric oil pump 25 will be described. Driving of the electric oil pump 25 is controlled based on the drive duty ratio that is set so as to be variable by the electronic control unit 26. The drive duty ratio is variable within a range, for example, "from 0% to 100%". Then, the work rate of the electric oil pump 25, in other words, the hydraulic pressure of the oil discharged from the electric oil pump 25 is adjusted based on the value of the drive duty ratio. More specifically, as the drive duty ratio comes closer to "0%", the work rate of the electric oil pump 25 decreases, and the hydraulic pressure of the oil discharged from the electric oil pump 25 decreases. On the other hand, as the drive duty ratio comes closer to "100%", the work rate of the electric oil pump 25 increases, and the hydraulic pressure of the oil discharged from the electric oil pump 25 increases.

Figure 4:
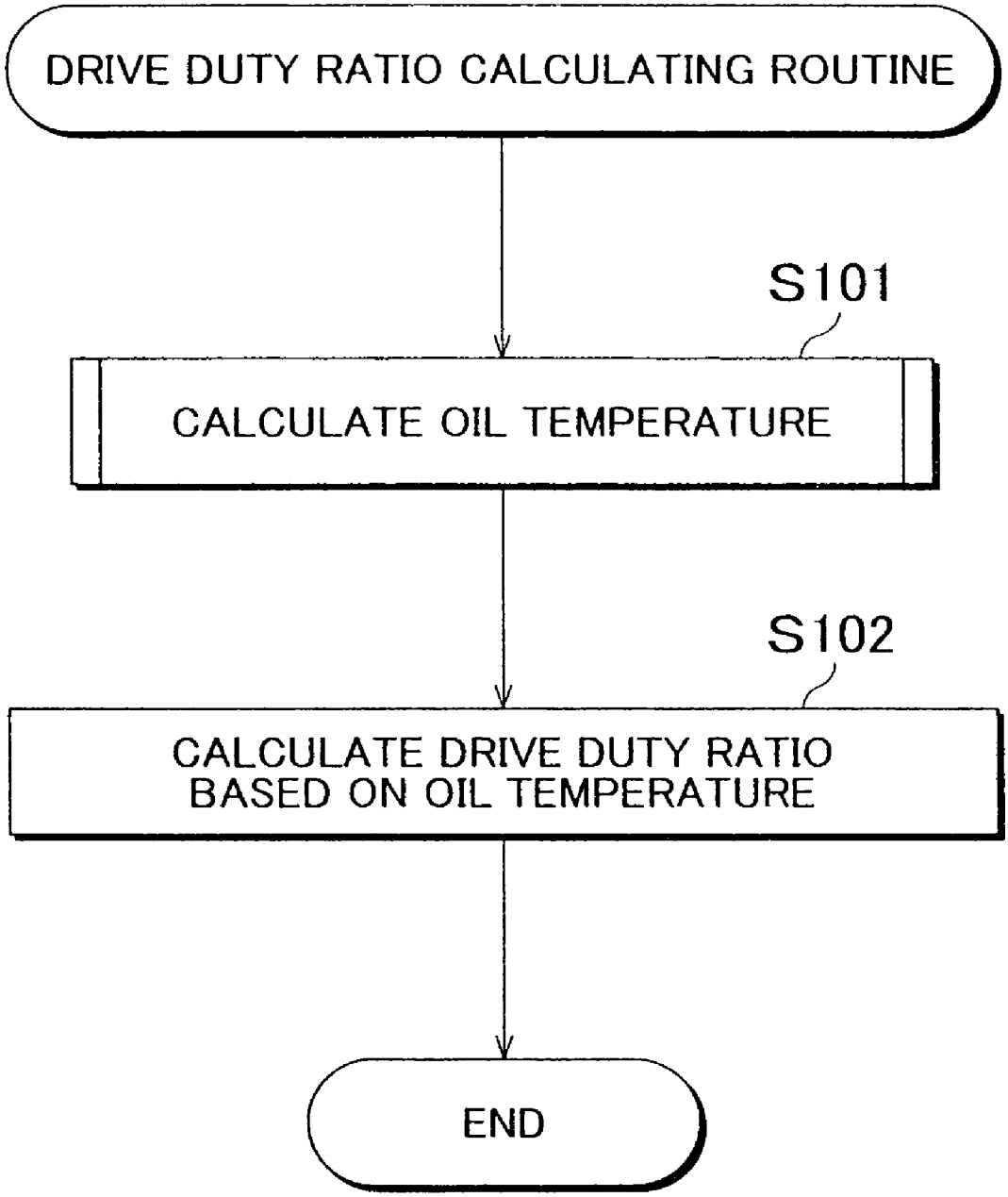
FIG. 4 is a flowchart showing a routine for calculating a drive duty ratio in the first embodiment.

FIG. 4 is a flowchart showing a drive duty ratio calculating routine for calculating the drive duty ratio. The drive duty ratio calculating routine is performed by the electronic control unit 26, for example, at predetermined intervals in an interrupt manner.

Figure 5:
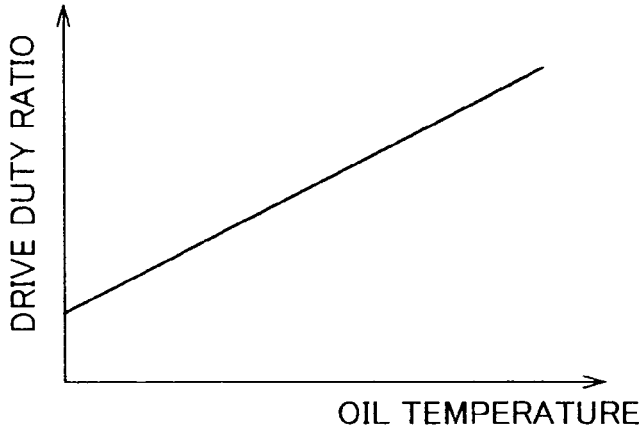
FIG. 5 is a graph showing a transition of the drive duty ratio with respect to a change in an oil temperature.

When the drive duty ratio calculating routine is started, first, the temperature of the oil supplied to the valve timing changing mechanism 13 is calculated in step S101, and then the drive duty ratio is calculated based on the oil temperature in step S102. The drive duty ratio is increased as the oil temperature increases, as shown in FIG. 5. The electric oil pump 25 is driven based on the drive duty ratio, whereby discharge of the oil to the valve timing changing mechanism 13 is assisted.

Figure 6:
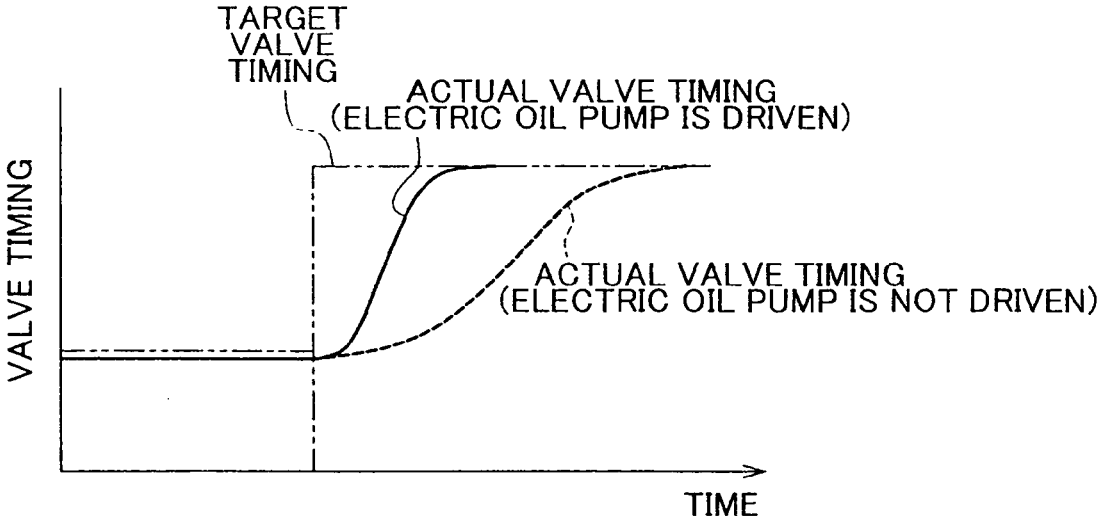
FIG. 6 is a time chart showing how actual valve timing is adjusted to target valve timing when the target valve timing is changed.

If the electric oil pump 25 is not driven while the oil temperature is high, when the target valve timing is changed based on the engine operating state, for example, as shown by a chain double-dashed line in FIG. 6, the adjustment-speed characteristic that adjusts the actual valve timing to the target valve timing deteriorates. As a result, after the target valve timing is changed (i.e., after timing T), the speed of adjustment of the actual valve timing to the target valve timing becomes slow, as shown by a dashed line in FIG. 6. As the oil temperature increases, the deterioration of the adjustment-speed characteristic becomes more significant. As the oil temperature increases, the hydraulic pressure of the oil supplied to the valve timing changing mechanism 13 decreases by a larger amount, and a response of the valve timing changing mechanism 13 is delayed.

However, since the electric oil pump 25 is driven according to the drive duty ratio calculated based on the oil temperature, discharge of the oil to the valve timing changing mechanism 13 is assisted such that the decrease in the hydraulic pressure is suppressed. Accordingly, it is possible to reliably suppress a delay in response of the valve timing changing mechanism 13 in order to adjust the actual valve timing to the target valve timing. As a result, the actual valve timing reaches the target valve timing used after timing T, as shown by a solid line in FIG. 6, by driving the valve timing changing mechanism 13.

Figure 7:
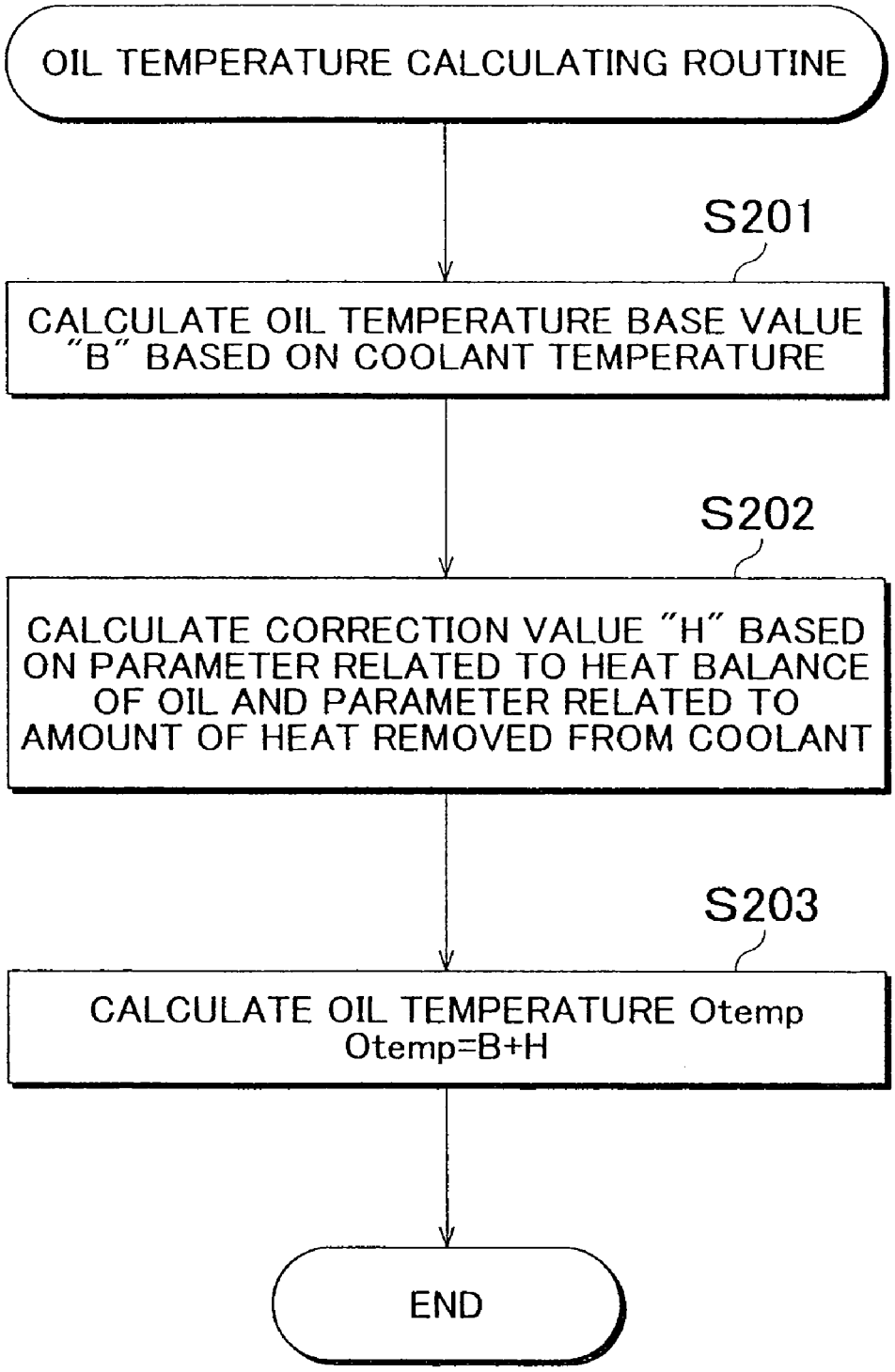
FIG. 7 is a flowchart showing a routine for calculating the oil temperature.

Next, an oil temperature calculating process in step S101 in the drive duty ratio calculating routine in FIG. 4 will be described in detail with reference to a flowchart in FIG. 7. The flowchart in FIG. 7 shows the oil temperature calculating routine in detail. The oil temperature calculating routine is performed by the electronic control unit 26 each time step S101 in the drive duty ratio calculating routine is performed.

In the oil temperature calculating routine, the oil temperature is calculated based on the temperature of the coolant for the engine 1, which changes according to the temperature of the oil supplied to the valve timing changing mechanism 13. Note that, although the coolant temperature changes according to the oil temperature, the coolant temperature and the oil temperature do not always change with the same changing pattern. The oil temperature is influenced by, for example, an amount of heat applied from the engine 1 to the oil and an amount of heat removed from the oil. The coolant temperature is influenced by, for example, an amount of heat removed from the coolant by a radiator provided in a passage through which the coolant is circulated. Therefore, the changing pattern may be different between the oil temperature and the coolant temperature. Accordingly, if the coolant temperature is used, without being corrected, as a value indicating the oil temperature, the value does not accurately indicate the oil temperature. Accordingly, in the oil temperature calculating routine, the oil temperature is calculated by using a parameter related to a heat balance of the oil, and a parameter related to the amount of heat removed from the coolant by the radiator of the automobile, in addition to the coolant temperature.

More specifically, an oil temperature base value B is calculated based on the coolant temperature in step S201, and a correction value H is calculated in step S202 by using the parameter related to the heat balance of the oil and the parameter related to the amount of heat removed from the coolant by the radiator. Then, in step S203, an oil temperature Otemp, which indicates the temperature of the oil, is calculated based on the oil temperature base value B and the correction value H by the following equation (1).

$$Otemp=B+H \ldots \quad \text{Equation (1)}$$

Otemp: oil temperature

B: oil temperature base value

H: correction value

Here, the oil temperature base value B and the correction value H, which are used for calculating the oil temperature Otemp, are calculated in methods that vary depending on the engine operating states. The methods of calculating the oil temperature base value B and the correction value H in the following engine operating states will be described. The engine operating states are the engine operating state "when starting of the engine 1 is initiated", the engine operating state "during a period from when cold starting of the engine 1 is initiated until when warming of the engine 1 is completed", and the engine operating state "when the vehicle is running at high load and high speed".

"When Starting of the Engine is Initiated"

Whether starting of the engine 1 has been initiated is determined based on whether the ignition switch 28 has been turned ON. When the ignition switch 28 has been turned ON, it is determined that starting of the engine 1 has been initiated.

Figure 8:
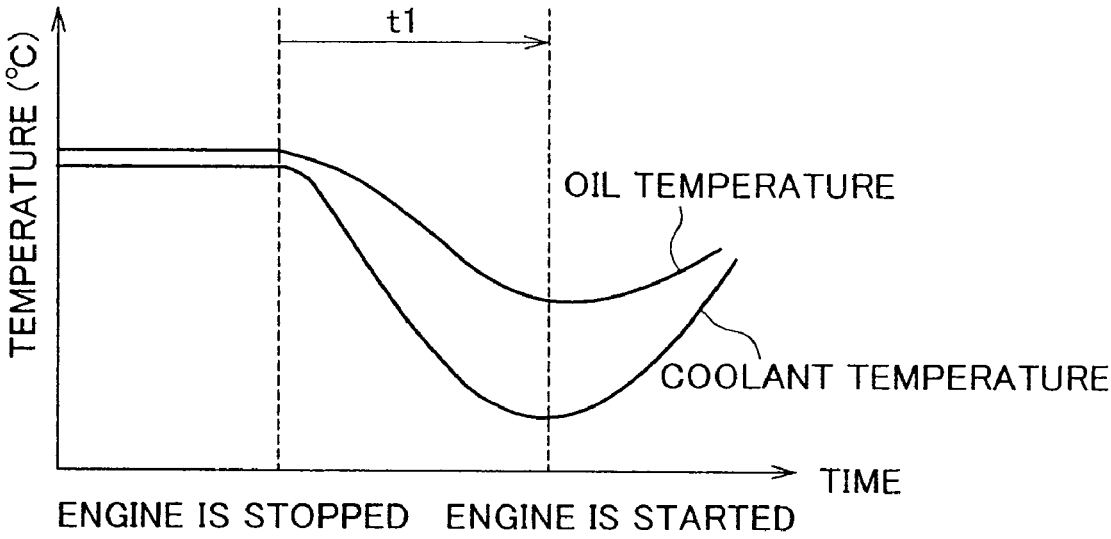
FIG. 8 is a time chart showing transitions of the oil temperature and a coolant temperature during a period from when an engine is stopped until when starting of the engine is initiated.

The oil temperature base value B calculated at this time becomes higher as the coolant temperature increases. However, the actual oil temperature when starting of the engine 1 is initiated is likely to be higher than the coolant temperature at the time. The oil supplied to the valve timing changing mechanism 13 is unlikely to be cooled, as compared with the coolant for the engine 1. Also, the oil temperature decreases more gently than the coolant temperature after stopping of the engine 1 is completed, as shown in FIG. 8. As shown in FIG. 8, the difference between the oil temperature and the coolant temperature becomes larger with time after stopping of the engine 1 is completed.

Accordingly, in this case, an elapsed time t1, namely, a time that elapses from when stopping of the engine 1 is completed until when starting of the engine 1 is initiated is used as the parameter related to the heat balance of the oil. Then, the correction value H is calculated based on the elapsed time t1. In a case where the elapsed time t1 is relatively short, as the elapsed time t1 increases, the oil temperature base value B is corrected by the correction value H by a larger amount. As the elapsed time t1 increases, a value obtained by the correction becomes higher than the oil temperature base value B by a larger amount. In a case where the elapsed time t1 is long, for example, in a case where the elapsed time t1 is a period until the coolant temperature is sufficiently decreased to a constant value, as the elapsed time t1 increases, the oil temperature base value B is corrected by the correction value H by a smaller amount. Correcting the oil temperature base value B by using the correction value H according to the equation (1) makes it possible to obtain the accurate oil temperature Otemp.

"During the Period from when Cold Starting of the Engine is Initiated Until when Warming of the Engine is Completed"

Whether the engine operating state is the state during the period from when cold starting of the engine 1 is initiated until when warming of the engine 1 is completed is determined based on whether the ignition switch 28 is OFF and the temperature of the coolant for the engine 1 is equal to or higher than a predetermined value. When the ignition switch 28 is OFF and the coolant temperature is equal to or higher than the predetermined value, it is determined that the engine operating state is the state during the period from when cold starting of the engine 1 is initiated until when warming of the engine 1 is completed.

Figure 9:
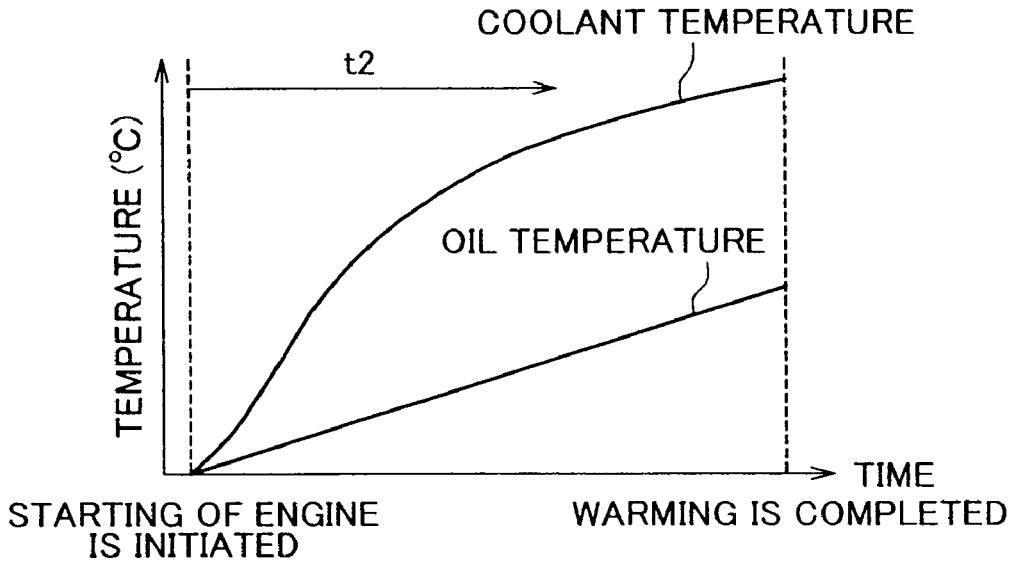
FIG. 9 is a time chart showing transitions of the oil temperature and the coolant temperature during a period from when cold starting of the engine is initiated until when warming of the engine is completed.

The oil temperature base value B calculated at this time increases as the coolant temperature increases. Note that, the actual oil temperature during the period from when cold starting of the engine 1 is initiated until when warming of the engine 1 is completed is likely to be lower than the coolant temperature at the time. The oil supplied to the valve timing changing mechanism 13 is unlikely to be warmed, as compared to the coolant for the engine 1. The oil temperature increases more gently than the coolant temperature after starting of the engine 1 is initiated, as shown in FIG. 9. FIG. 9 shows transitions of the oil temperature and the coolant temperature after the engine 1 is started in the state where a long time has elapsed since the engine 1 is stopped and the oil temperature has been decreased to the coolant temperature. As shown in FIG. 9, the difference between the oil temperature and the coolant temperature becomes larger with time during the period from when cold starting of the engine 1 is initiated until when warming of the engine 1 is completed.

The difference between the oil temperature and the coolant temperature changes based on a total amount of heat generated in the engine 1 after starting of the engine 1 is initiated. The total heat amount is determined based on a total amount of fuel which has been burned since starting of the engine 1 is initiated. The total heat amount increases as the total amount of burned fuel increases. In the engine 1, the fuel injection amount is controlled based on the intake air amount. Accordingly, as an accumulated value indicating the amount of air that has been taken in the engine 1 since starting of the engine 1 is initiated increases, the total amount of burned fuel increases, resulting in an increase in the total heat amount.

Accordingly, as the parameter related to the heat balance of the oil, at least one of an elapsed time t2 and an accumulated value ΣGA1 is used. The elapsed time t2 is a time that has elapsed since starting of the engine 1 is initiated. The accumulated value ΣGA1 a value indicating an amount of air that has been taken in the engine 1 since starting of the engine 1 is initiated. Then, the correction value H is calculated based on the elapsed time t2 and the accumulated value ΣGA1. As the elapsed time t2 increases, or as the accumulated value ΣGA1 increases, the oil temperature base value B is corrected by the correction value H by a larger amount. As the elapsed time t2 increases, or as the accumulated value ΣGA1 increases, a value obtained by the correction becomes lower than the oil temperature base value B by a larger amount. Correcting the oil temperature base value B by using the correction value H according to the equation (1) makes it possible to obtain the accurate oil temperature Otemp.

"When the Vehicle is running at high load and high speed"

Whether the vehicle is running at high load and high speed is determined based on whether both the engine load and the vehicle speed are equal to or higher than predetermined values. Note that, the engine load used here can be calculated based on the engine rotational speed and the intake air amount. When both the engine load and the vehicle speed are equal to or higher than the predetermined values, it is determined that the vehicle is running at high load and high speed.

Figure 10:
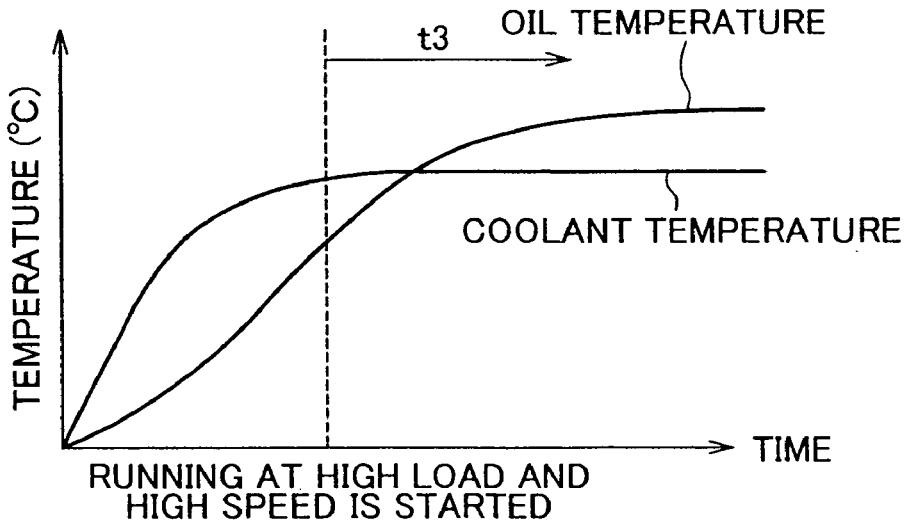
FIG. 10 is a time chart showing transitions of the oil temperature and the coolant temperature when a vehicle is running at high load and high speed.

The oil temperature base value B calculated at this time increases as the coolant temperature increases. Note that, the actual oil temperature when the vehicle is running at high load and high speed is likely be lower than the coolant temperature at the time. The coolant for the engine 1 is cooled more effectively than the oil supplied to the valve timing changing mechanism 13, since the coolant is cooled by the radiator of the automobile. Accordingly, the coolant temperature is maintained at a substantially constant value, but the oil temperature increases, as shown in FIG. 10. As shown in FIG. 10, when the vehicle is running at high load and high speed, the oil temperature increases with time, and the oil temperature eventually becomes higher than the coolant temperature.

The difference between the oil temperature and the coolant temperature changes also based on the total amount of heat generated in the engine 1 after running at high load and high speed is started. The total heat amount increases, as an accumulated value ΣGA2, which indicates an amount of air that has been taken in the engine 1 since the running at high load and high speed is started, increases, and as the engine load increases. In addition, the difference between the oil temperature and the coolant temperature changes also based on the amount of heat removed from the coolant for the engine 1. The heat amount increases, as the flow volume of coolant flowing through the radiator when the vehicle is running at high load and high speed increases, and as the flow volume of air contacting the radiator increases. The flow volume of coolant flowing through the radiator increases, as the work rate of the water pump increases due to an increase in the engine rotational speed. The flow volume of air contacting the radiator increases, as the vehicle speed increases. Accordingly, the amount of heat removed from the coolant for the engine 1 increases, as the engine rotational speed and the vehicle speed increase.

Accordingly, in this case, as the parameter related to the heat balance of the oil, at least one of an elapsed time t3, the accumulated value ΣGA2, and the engine load is used. The elapsed time t3 is a time that has elapsed since the running at high load and high speed is started. The accumulated value ΣGA2 is a value indicating the amount of air that has been taken in the engine 1 since the running at high load and high speed is started. In addition, as the parameter related to the amount of heat removed from the coolant by the radiator, at least one of the engine rotational speed and the vehicle speed is used. Then, the correction value H is calculated based on the elapsed time t3, the accumulated value ΣGA2, the engine load, the engine rotational speed, and the vehicle speed. The thus obtained correction value H corrects the oil temperature base value B to a value close to the actual oil temperature. Correcting the oil temperature base value B by using the correction value H according to the equation (1) makes it possible to obtain the accurate oil temperature Otemp.

According to the first embodiment described so far in detail, the following effects can be obtained.

(1) The valve timing changing mechanism 13 is supplied with the oil discharged from the electric oil pump 25 that is driven independently of the operation of the engine 1 in addition to the oil discharged from the mechanical oil pump 23 that is driven by the operation of the engine 1. In this case, as the temperature of the oil supplied to the valve timing changing mechanism 13 increases, the amount of oil leaking from the valve timing changing mechanism 13 and the oil supply passage through which oil is supplied to the valve timing changing mechanism 13 increases due to reduction in the viscosity of the oil. Therefore, the hydraulic pressure of the oil supplied to the valve timing changing mechanism 13 decreases by a larger amount, and the response of the valve timing changing mechanism 13 is likely to be delayed. For the purpose of addressing such a problem, according to the first embodiment, the electric oil pump 25 is driven such that, as the oil temperature increases, the work rate of the electric oil pump 25 increases, in other words, the hydraulic pressure of the oil discharged from the electric oil pump 25 increases. Accordingly a decrease in the hydraulic pressure of the oil supplied to the valve timing changing mechanism 13 is suppressed, and a delay in response of the valve timing changing mechanism 13 is suppressed. It is, therefore, possible to reduce the possibility that the adjustment-speed characteristic that adjusts the actual valve timing to the variable target valve timing deteriorates as the oil temperature increases.

(2) The temperature of the oil supplied to the valve timing changing mechanism 13 can be calculated based on the temperature of the coolant for the engine 1, without providing an oil temperature sensor for detecting the oil temperature. However, as mentioned above, if the temperature of the coolant for the engine 1 is used, without being corrected, as a value indicating the oil temperature, the value does not indicate the oil temperature accurately. For the purpose of addressing such a problem, according to the first embodiment, as shown by the equation (1), the oil temperature Otemp of the oil is calculated by correcting the oil temperature base value B calculated based on the coolant temperature by using the correction value H that is calculated based on the parameter related to the heat balance of the oil. Since the oil temperature Otemp is calculated by using the parameter in addition to the coolant temperature, the oil temperature Otemp thus calculated can be regarded as an accurate value indicating the oil temperature.

(3) As the parameter related to the heat balance of the oil, the elapsed time t1 which is a time that has elapsed since stopping of the engine 1 is completed is used, when starting of the engine 1 is initiated. Although both the coolant temperature and the oil temperature decrease after stopping of the engine 1 is initiated, the oil temperature decreases more gently than the coolant temperature. Accordingly, the difference between the oil temperature and the coolant temperature changes based on the elapsed time t1. Therefore, the oil temperature Otemp which is calculated by correcting the oil temperature base value B by using the correction value H that is calculated using the elapsed time t1 can be regarded as an accurate value indicating the oil temperature when starting of the engine 1 is initiated.

(4) Also, as the parameter related to the heat balance of the oil, at least one of the elapsed time t2 which is a time that has elapsed since starting of the engine 1 is initiated, and the accumulated value ΣGA2 indicating the amount of air that has been taken in the engine 1 since starting of the engine 1 is initiated is used during the period from when starting of the engine 1 is initiated while the engine 1 is cooled until when warming of the engine 1 is completed. In this case, although both the coolant temperature and the oil temperature increase during this period, the oil temperature increases more gently than the coolant temperature. The difference between the oil temperature and the coolant temperature changes based on the elapsed time t2 and the accumulated value ΣGA2. Therefore, the oil temperature Otemp is calculated by correcting the oil temperature base value B by using the correction value H that is calculated by using at least one of the elapsed time t2 and the accumulated value ΣGA2. The thus obtained oil temperature Otemp can be regarded as an accurate value indicating the oil temperature during the period from when starting of the engine 1 is initiated while the engine 1 is cooled until when warming of the engine 1 is completed.

(5) Also, as the parameter related to the heat balance of the oil, when the vehicle is running at high load and high speed, at least one of an elapsed time t3, the accumulated value ΣGA2, and the engine load is used. The elapsed time t3 is a time that has elapsed since the running at high load and high speed is started. The accumulated value ΣGA2 is a value indicating the amount of air that has been taken in the engine 1 since the running at high load and high speed is started. In addition, as the parameter related to the amount of heat removed from the coolant by the radiator, at least one of the engine rotational speed and the vehicle speed is used. When the vehicle is running at high load and high speed, the coolant is cooled more effectively than the oil, since the coolant is cooled by the radiator. Accordingly, the coolant temperature is maintained at a substantially constant value, but the oil temperature increases. The difference between the oil temperature and the coolant temperature changes based on the parameters related to the heat balance of the oil, such as the elapsed time t3, the accumulated value ΣGA2, and the engine load. Also, the difference between the oil temperature and the coolant temperature changes based on the parameters related to the amount of heat removed from the coolant by the radiator, such as the engine rotational speed and the vehicle speed. Therefore, the oil temperature Otemp is calculated by correcting the oil temperature base value B by using the correction value H that is calculated using the above-mentioned parameters. The thus calculated oil temperature Otemp can be regarded as an accurate value indicating the oil temperature when the vehicle is running at high load and high speed.

Second Embodiment

Hereafter, a second embodiment of the invention will be described with reference to FIGS. 11 and 12. In the second embodiment, the work rate of the electric oil pump 25 is changed based on the amount of difference between the actual valve timing and the target valve timing, unlike the first embodiment in which the work rate of the electric oil pump 25 is changed based on the temperature of the oil supplied to the valve timing changing mechanism 13.

Figure 11:
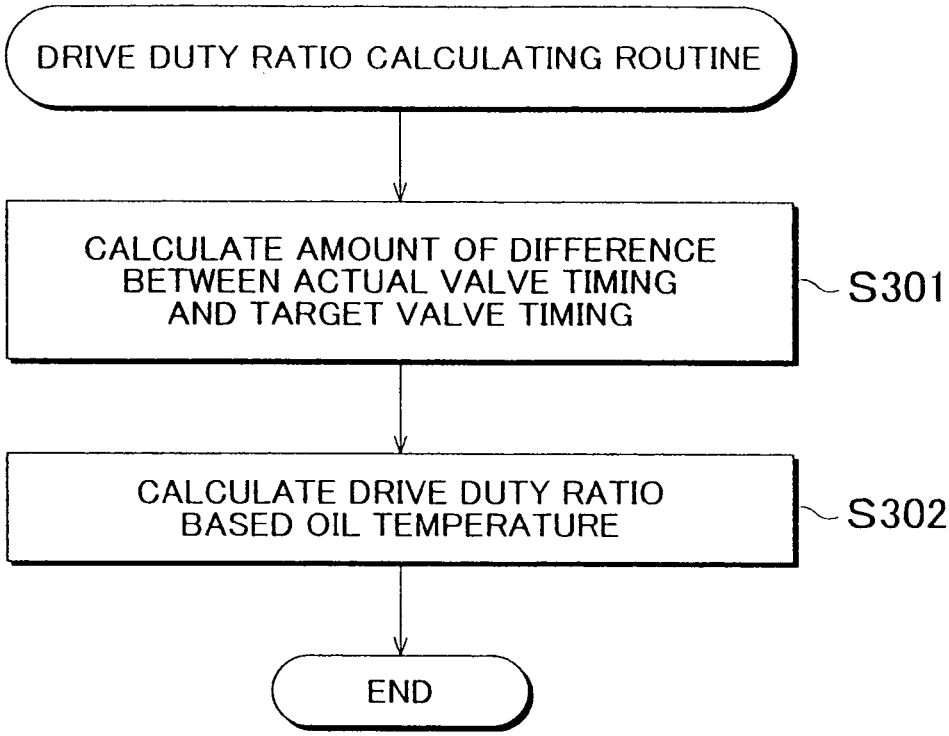
FIG. 11 is a flowchart showing a routine for calculating the drive duty ratio in a second embodiment of the invention.
Figure 12:
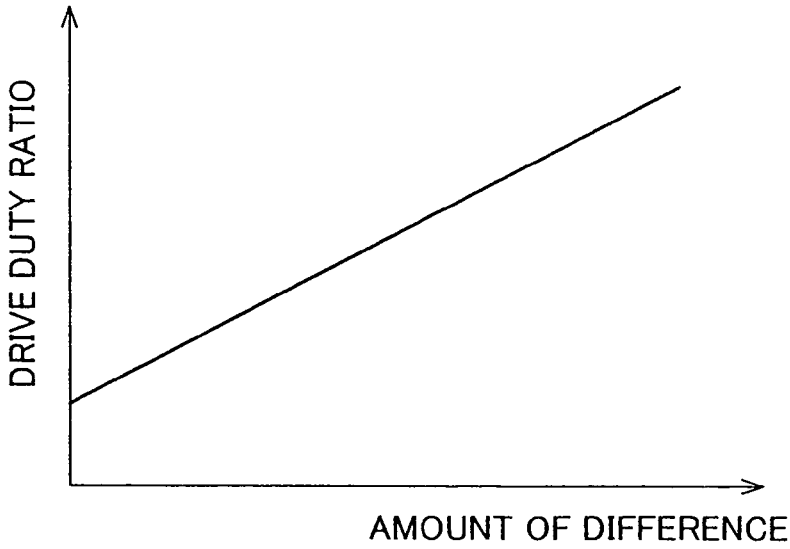
FIG. 12 is a graph showing a transition of the drive duty ratio with respect to a change in an amount of difference between the actual valve timing and the target valve timing.

FIG. 11 is a flowchart showing a drive duty ratio calculating routine in the second embodiment. In the drive duty ratio calculating routine, first, the amount of difference between the actual valve timing and the target valve timing is calculated in step S301. When the actual valve timing is adjusted to the target valve timing by performing the valve timing control, as the oil temperature increases and the response of the valve timing changing mechanism 13 is delayed, the adjustment-speed characteristic that adjusts the actual valve timing to the variable target valve timing deteriorates. Therefore, the amount of difference between the actual valve timing and the target valve timing is likely to increase, as the oil temperature increases.

In step S302, the drive duty ratio is calculated based on the amount of difference. The drive duty ratio thus calculated increases, as the amount of difference increases, as shown in FIG. 12. The electric oil pump 25 is driven based on the drive duty ratio, and discharge of the oil to the valve timing changing mechanism 13 is assisted. Accordingly, as the amount of difference increases, the work rate of the electric oil pump 25 increases and the hydraulic pressure of the oil discharged from the electric oil pump 25 increases. It is, therefore, possible to reliably suppress a delay in response of the valve timing changing mechanism 13 due to an increase in the oil temperature.

According to the second embodiment, the following effect can be obtained.

(6) As the temperature of the oil supplied to the valve timing changing mechanism 13 increases, the amount of difference between the actual valve timing and the target valve timing is likely to increase. The electric oil pump 25 is driven such that, as the amount of difference increases, the work rate of the electric oil pump 25 increases, in other words, the hydraulic pressure of the oil discharged from the electric oil pump 25 increases. Therefore, a delay in response of the valve timing changing mechanism 13 due to an increase in the oil temperature is suppressed. As a result, it is possible to reduce the possibility that the adjustment-speed characteristic that adjusts the actual valve timing to the variable target valve timing deteriorates as the oil temperature increases.

Third Embodiment

Hereafter, a third embodiment of the invention will be described with reference to FIGS. 13 and 14. In the third embodiment, the work rate of the electric oil pump 25 is changed based on the duty ratio command value used for controlling driving of the OCV 19, instead of changing the work rate of the electric oil pump 25 in the manner mentioned in the first embodiment and the second embodiment. More specifically, the work rate of the electric oil pump 25 is changed based on which region in the range "from −50% to 50%" the duty ratio command value is in, namely, based on the driving region of the valve timing changing mechanism 13.

Figure 13:
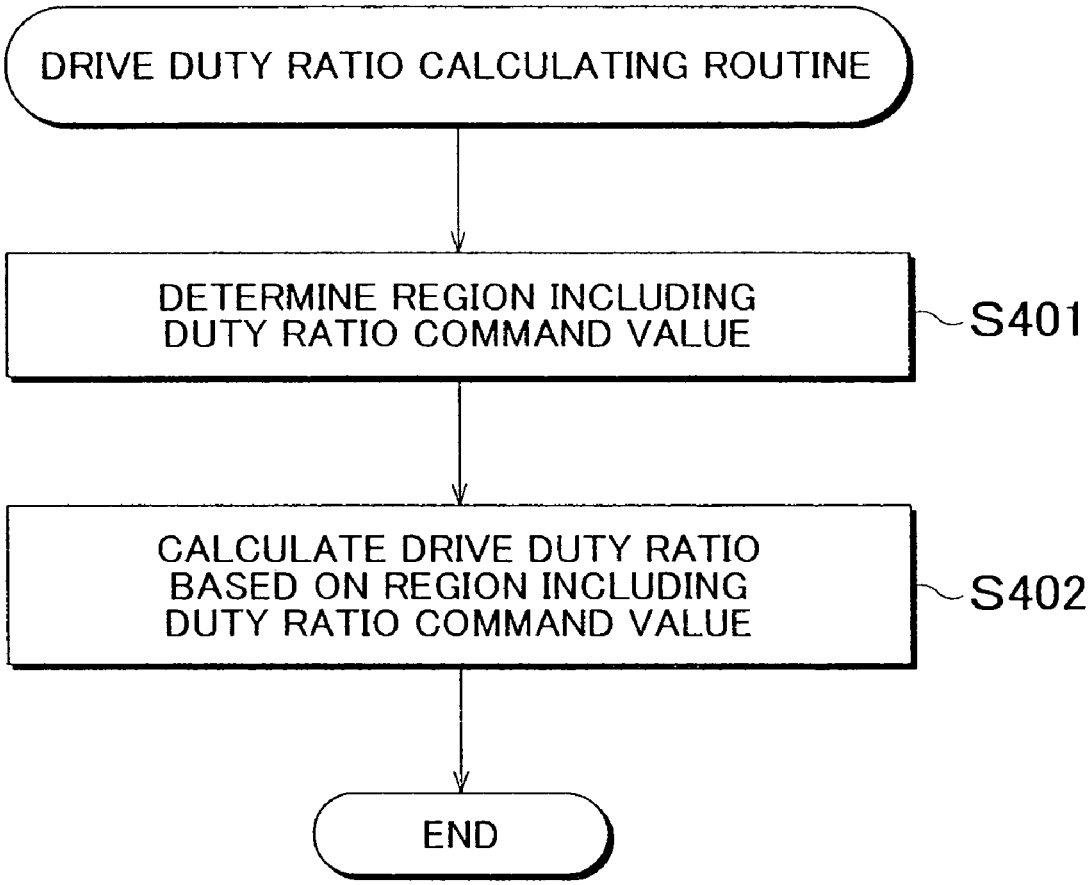
FIG. 13 is a flowchart showing a routine for calculating the drive duty ratio in a third embodiment of the invention.
Figure 14:
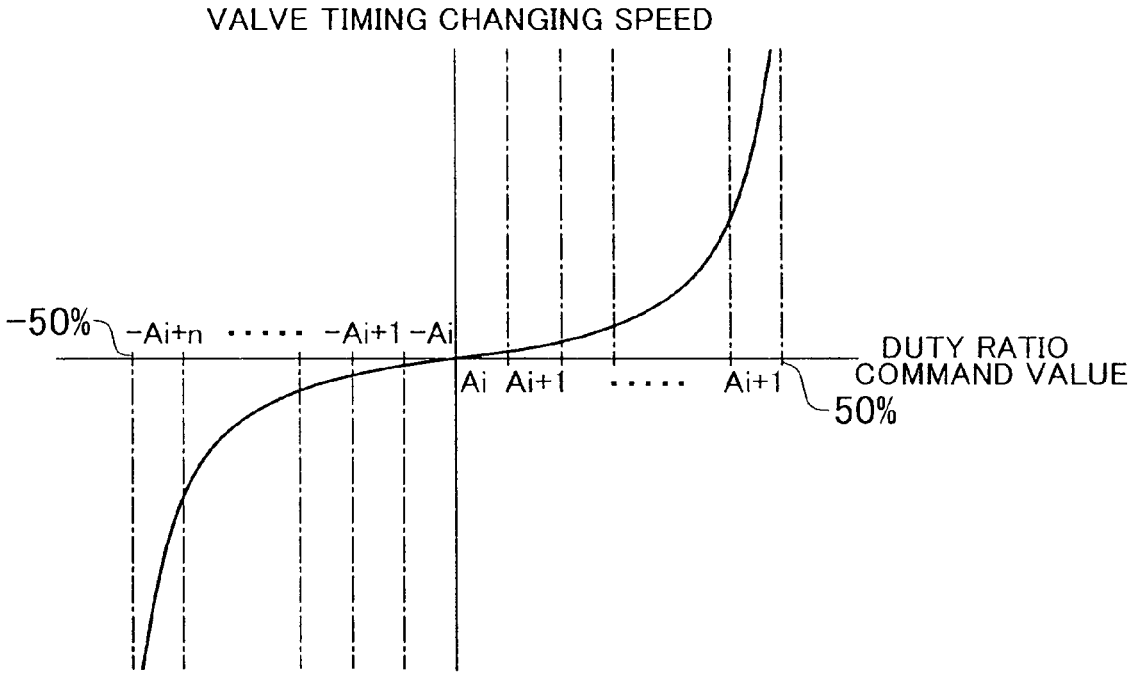
FIG. 14 is a graph showing a transition of a speed of change in the valve timing with respect to a change in a duty ratio command value.

FIG. 13 is a flowchart showing a drive duty ratio calculating routine in the third embodiment. In the drive duty ratio calculating routine, first, it is determined in step S401 which of the regions "from Ai to Ai+n" and "from −Ai to −Ai to+n" in the range "from −50% to 50%" shown in FIG. 14 the duty ratio command value is in.

The region "from Ai to Ai+n" is in a range "from 0% to 50%" in which the valve timing is advanced. As the duty ratio command value comes closer to "Ai+n", the duty ratio command value comes closer to "50%". The region "from −Ai to −Ai to+n" is in a range "from −50% to 0%" in which the valve timing is retarded. As the duty ratio command value comes closer to "−Ai+n", the duty ratio command value comes closer to "−50%". In FIG. 14, a solid line indicates a transition of a speed of change in the valve timing with respect to a change in the duty ratio command value. As shown in FIG. 14, the speed of change in the valve timing becomes the minimum value when the duty ratio command value is "0", and becomes higher as the duty ratio command value comes closer to "−50%" or "50%".

In the region where the speed of change is likely to be higher, a negative effect caused by a delay in response of the valve timing changing mechanism 13 due to an increase in the oil temperature becomes more significant. In the region where the speed of change is likely to be higher, the target speed at which the actual valve timing is adjusted to the target valve timing becomes higher. Although high response is required to achieve the target speed, the response is delayed.

In step S402, the drive duty ratio is calculated based on which region the duty ratio command value is in. The drive duty ratio thus calculated is increased, as the region including the duty ratio command value comes closer to "−50%" or "50%", namely, as the region comes closer to "−Ai+n" or "Ai+n". Then, the electric oil pump 25 is driven based on the thus calculated drive duty ratio, and discharge of oil to the valve timing changing mechanism 13 is assisted. Accordingly, in the region where the speed of change is likely to be higher, the work rate of the electric oil pump 25 becomes higher, and, therefore, the hydraulic pressure of the oil discharged from the electric oil pump 25 becomes higher. As a result, in such a region, it is possible to reliably suppress a delay in response due to an increase in the hydraulic pressure, and the negative effect due to the delay in response.

According to the third embodiment, the following effects can be obtained.

(7) In the region which includes the duty ratio command value and which is closer to "−Ai+n" that is close to "−50%" or "Ai+n" that is close to "50%", namely, in region where the speed of change in the valve timing with respect to the change in the duty ratio command value is likely to be higher, the electric oil pump 25 is driven such that the work rate of the electric oil pump 25 becomes higher. In the region where the speed of change in the valve timing with respect to the change in the duty ratio command value is likely to be higher, a negative effect caused by a delay in response of the valve timing changing mechanism 13 due to an increase in the oil temperature becomes more significant. However, the electric oil pump 25 is drive in the above-mentioned manner. As a result, in such a region, a delay in response due to an increase in the hydraulic pressure, and the negative effect due to the delay in response can be reliably suppressed. It is, therefore, possible to suppress deterioration of the adjustment-speed characteristic that adjusts the actual valve timing to the variable target valve timing.

Fourth Embodiment

Hereafter, a fourth embodiment of the invention will be described with reference to FIGS. 15 and 16. The fourth embodiment is made in order to obtain the following effects in addition to the effects obtained in the first to third embodiments. According to the fourth embodiment, it is possible to suppress engine stalling caused by driving the electric oil pump 25 during idling operation. It is also possible to suppress deterioration of a target-reaching characteristic that causes the actual valve timing to reach the target valve timing due to a change in the work rate of the electric oil pump 25 during valve timing control.

Figure 15:
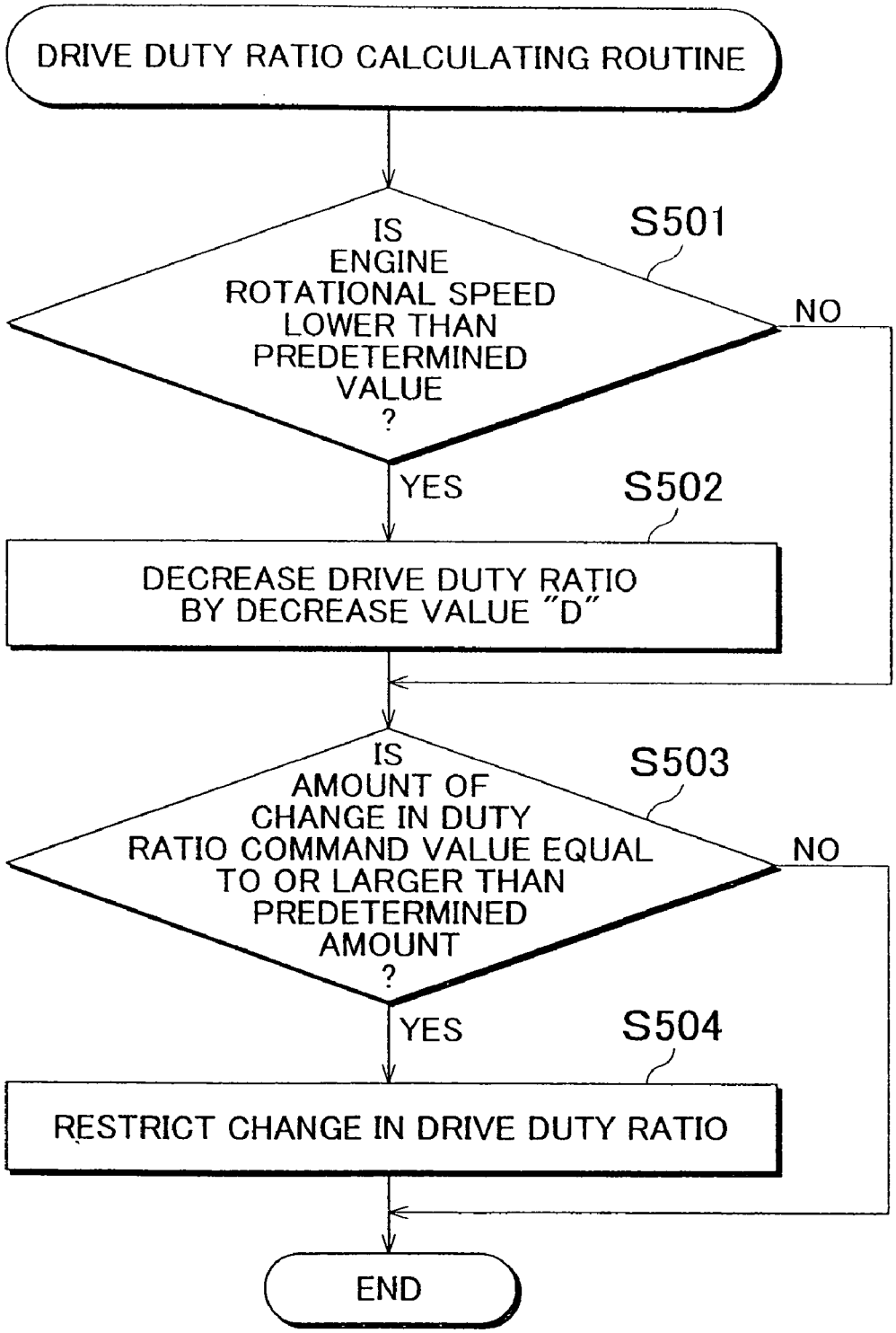
FIG. 15 is a flowchart showing a routine for controlling the drive duty ratio in a fourth embodiment.
Figure 16:
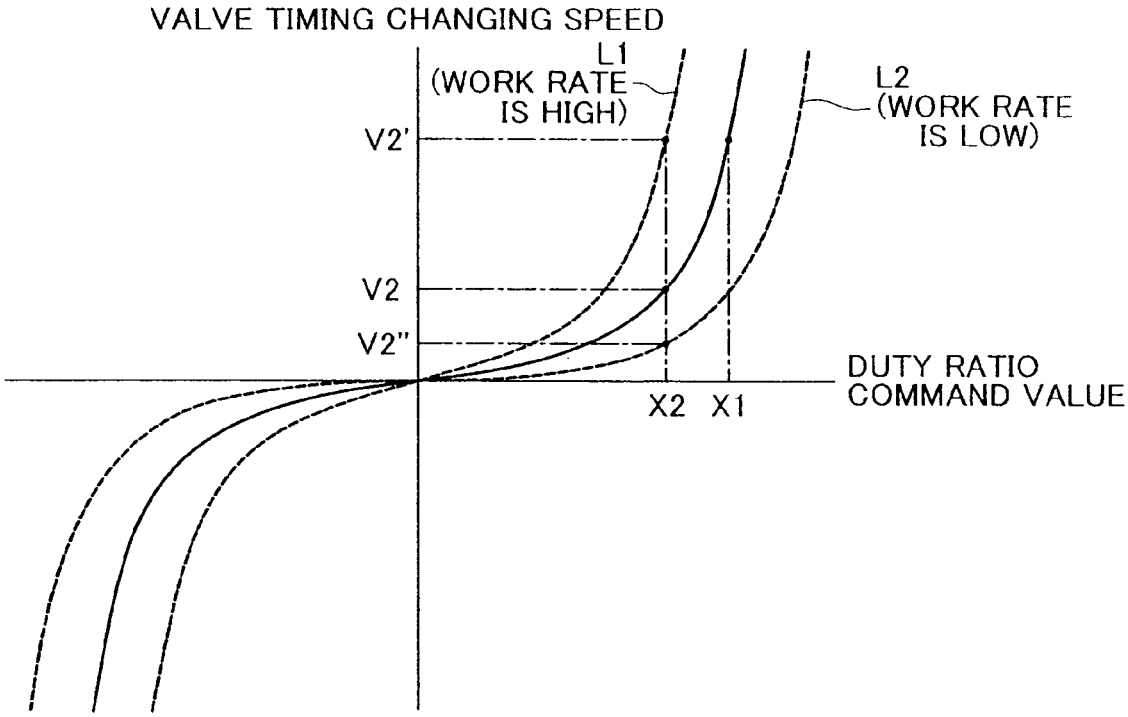
FIG. 16 is a graph showing a transition of a speed of change in the valve timing with respect to a change in the duty ratio command value.

FIG. 15 is a flowchart showing a drive duty ratio control routine for suppressing the engine stalling and deterioration of the target-reaching characteristic. The drive duty ratio control routine is performed by the electronic control unit 26 at predetermined intervals in an interrupt manner.

In the drive duty ratio control routine, first, it is determined in step S501 whether the engine rotational speed is lower than a predetermined value that is equal to or lower than the idle speed. An affirmative determination is made in the state where the electric oil pump 25 is driven during the idling operation. In such a state, since the electric power for driving the electric oil pump 25 is supplied from a battery and an alternator, an electrical load of the engine 1 (a drive load of the alternator) increases when the electric oil pump 25 is driven, and the engine rotational speed is likely to be decreased due to an increase in the electrical load. Accordingly, during the idling operation in which the engine rotational speed decreases, the engine rotational speed decreases due to driving of the electric oil pump 25, causing a possibility of engine stalling.

However, according to this drive duty ratio control routine, when an affirmative determination is made in step S501, the drive duty ratio is decreased by a predetermined decrease value D in step S502. Thus, the electric oil pump 25 is driven such that the work rate of the electric oil pump 25 decreases, in other words, the hydraulic pressure of the oil discharged from the electric oil pump 25 decreases. As a result, the electrical load of the engine 1 is reduced, and, therefore, the engine stalling due to a decrease in the engine rotational speed can be suppressed.

The transition of the speed of change in the valve timing with respect to the change in the duty ratio command value changes based on the work rate of the electric oil pump 25. For example, in a state where the speed of change in the valve timing with respect to the change in the duty ratio command value undergoes a transition as indicated by a solid line in FIG. 16, if the work rate of the electric oil pump 25 is increased, discharge of the oil to the valve timing changing mechanism 13 is assisted more effectively. Accordingly, the inclination of the line indicating the transition of the speed of change in the valve timing with respect to the change in the duty ratio command value becomes steeper. The state of transition is changed to a state indicated by a dashed line L1. Meanwhile, when the work rate of the electric oil pump 25 is decreased, discharge of the oil to the valve timing changing mechanism 13 is assisted less effectively. Accordingly, the inclination of the line indicating the transition of tho speed of change in the valve timing with respect to the change in the duty ratio command value becomes more gentle. The state of transition is changed to a state indicated by a dashed line L2.

However, when the duty ratio command value is changed by a large amount in order to cause the actual valve timing to reach the target valve timing, if a change occurs in the state of transition of the speed of change in the valve timing, the target-reaching characteristic that causes the actual valve timing to reach the target valve timing deteriorates. The following description will be made on the assumption that, when the speed of change in the valve timing undergoes a transition as indicated by the solid line in FIG. 16, the duty ratio command value is changed by a large amount from "X1" to "X2" in order to cause the actual valve timing to reach the target valve timing.

In this case, the speed of change in the valve timing is supposed to be V2 after the duty ratio command value is changed. However, if the work rate of the electric oil pump 25 is changed and the state of transition of the speed of change in the valve timing is changed to the state shown by the dashed line L1 or the dashed line L2 shown in FIG. 16, the speed of change in the valve timing after the duty ratio command value is changed becomes a speed V2' or a speed V2" that deviates from the speed V2 by a large amount. Accordingly, when the duty ratio command value is changed, the actual valve timing cannot reach the target valve timing promptly, and the target-reaching characteristic deteriorates.

Accordingly, in the drive duty ratio control routine, it is determined in step S503 whether the duty ratio command value is equal to or higher than a predetermined value. In step S504, a change in the drive duty ratio is restricted. As the restriction of the drive duty ratio, an amount of change in the drive duty ratio may be made small, or the drive duty ratio may be prohibited from being changed. The change in the drive state of the electric oil pump 25 is restricted by restricting the change in the drive duty ratio, making it possible to reduce the possibility that the transition of the speed of change in the valve timing is changed by a large amount due to the change in the drive state of the electric oil pump 25. It is, therefore, possible to reduce the possibility that the target-reaching characteristic that causes the actual valve timing to reach the target valve timing deteriorates dues to an considerable change in the transition.

According to the fourth embodiment, in addition to the effects (1) to (7) described in the first to the third embodiments, the following effects can be obtained.

(8) When the engine rotational speed becomes lower than the predetermined value that is equal to or lower than the idle speed, the drive duty ratio is decreased by the decrease value D, and the work rate of the electric oil pump 25 is reduced. Accordingly, the electrical load of the engine 1 is decreased and a decrease in the engine rotational speed is suppressed. It is, therefore, possible to reduce the possibility that the engine rotational speed is decreased due to driving of the electric oil pump 25 during idling operation, resulting in engine stalling.

(9) When the duty ratio command value is changed by a large amount, the change in the drive duty ratio is restricted, and the state of transition of the speed of change in the valve timing with respect to the change in the duty ratio command value is prevented from changing to a considerably different state. It is, therefore, possible to reduce the possibility that the target-reaching characteristic that causes the actual valve timing to reach the target valve timing deteriorates due to a considerable change in the transition of the speed of change in the valve timing. As a result, reduction in controllability of the valve timing control due to deterioration of the target-reaching characteristic can be suppressed.

Figure 17:
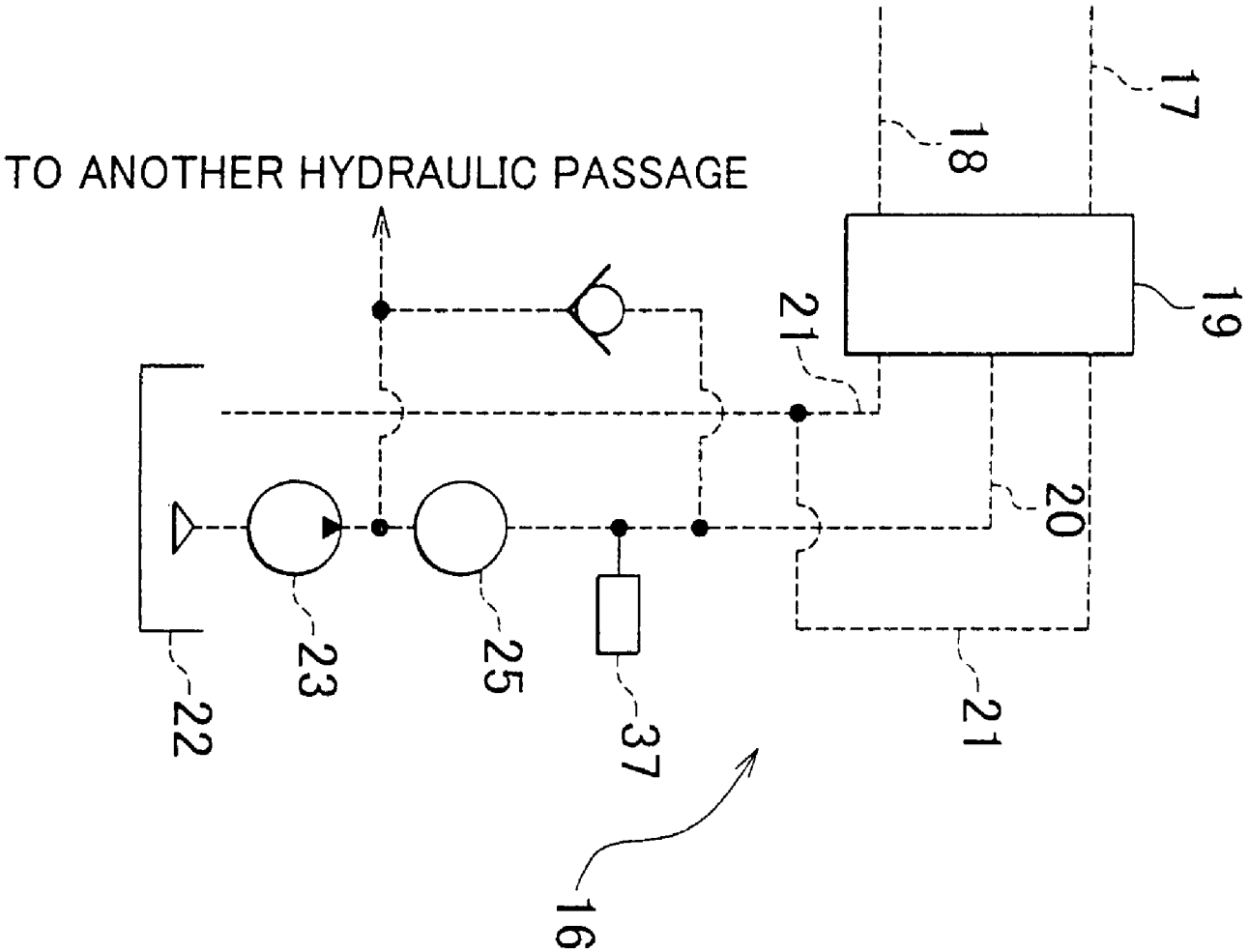
FIG. 17 is a hydraulic circuit diagram showing a connection state of an accumulator when the accumulator is used.

Note that, the above-mentioned embodiments can be modified as follows. As shown in FIG. 17, an accumulator 37 may be connected to the supply passage 20 of the hydraulic circuit 16 at a position downstream of the mechanical oil pump 23. In this case, when engine is operating relatively stably, for example, when the rotational speed of the engine 1 is decreased or when idling operation is performed, the hydraulic pressure of the oil supplied to the valve timing changing mechanism 13 is accumulated by the accumulator 37. When the valve timing needs to be changed rapidly, for example, when the rotational speed of the engine 1 is increased, the valve timing changing mechanism 13 is driven by using the hydraulic pressure accumulated by the accumulator 37. Accordingly, when the valve timing needs to be changed rapidly, for example, when the rotational speed of the engine 1 is increased, the hydraulic pressure of the oil discharged from the electric oil pump 25, in other words, the work rate of the electric oil pump 25 can be made low while the response of the valve timing changing mechanism 13 is maintained at a required level. Since the work rate of the electric oil pump 25 is made low, the electrical load of the engine 1 due to driving of the electric oil pump 25 is reduced, and the fuel efficiency of the engine 1 can be improved.

The drive duty ratio may be calculated so as to be higher as the viscosity of the oil supplied to the valve timing changing mechanism 13 is reduced, and the electric oil pump 25 may be driven such that the work rate thereof increases as the viscosity of the oil is reduced. In this case, the same effects as those in the first and second embodiments can be obtained. Note that, the viscosity of the oil used in this case may be detected by a viscosity sensor.

In the fourth embodiment, the change in the drive duty ratio may be restricted only in the region where the amount of change in the speed of change in the valve timing with respect to the change in the duty ratio command value is large. For example, the change in the drive duty ratio may be restricted only when the duty ratio command value is in the region near "−50%" or "50%". In the region near "−50%" or "50%", a deviation of the speed of change in the valve timing due to a change in the work rate of the electric oil pump 25 becomes large. However, deterioration of the controllability of the valve timing control due to the deviation can be suppressed by restricting the drive duty ratio.

In the fourth embodiment, the decrease value D for decreasing the drive duty ratio may be set so as to be variable. For example, as the amount of decrease in the engine rotational speed from the predetermined value used in step S501 becomes larger, the decrease value D may be increased.

Instead of decreasing the drive duty ratio by the decrease value D, the drive duty ratio may be set to "0" such that the electric oil pump 25 is stopped.

In the third embodiment, in the region where the duty ratio command value is close to "0", namely, the region near "Ai"or "−Ai", driving of the electric oil pump 25 may be stopped. In the region near "Ai" or "−Ai", since the negative effect caused by a delay in response of the valve timing changing mechanism 13 due to an increase in the oil temperature is not very significant, driving of the electric oil pump 25 can be stopped.

In the first embodiment, the temperature of the oil supplied to the valve timing changing mechanism 13 is calculated based on the coolant temperature, or the like. However, the temperature of the oil supplied to the valve timing changing mechanism 13 may be detected by using an oil temperature sensor.

In the first to fourth embodiments, a hydraulically driven lift amount changing mechanism may be used. This lift amount changing mechanism is also a valve characteristic changing mechanism driven by a hydraulic pressure. In this case, the valve timing changing mechanism 13 may be driven by a drive source such as an electric motor, instead of being driven by a hydraulic pressure.

The invention may be applied to an engine including a valve timing changing mechanism which changes the valve timing of the exhaust valve 10 by using a hydraulic pressure, and a maximum lift amount changing mechanism which changes the maximum lift amount of exhaust valve 10 and the working angle of the exhaust cam by using a hydraulic pressure.

The invention may be realized by combining two or more of the first to fourth embodiments.

What is claimed is:

1. A variable valve system of an internal combustion engine, comprising:

a mechanical oil pump which is driven by an operation of an internal combustion engine;

a valve characteristic changing mechanism which is driven by a hydraulic pressure of oil discharged from the mechanical oil pump, thereby changing a valve characteristic of an engine valve;

an electric oil pump which discharges oil for driving the valve characteristic changing mechanism; and a computer which controls the valve characteristic changing mechanism such that the valve characteristic of the engine valve is adjusted to a target characteristic that is set based on an engine operating state;

wherein the computer drives the electric oil pump such that, as a temperature of the oil supplied to the valve characteristic changing mechanism increases, a hydraulic pressure of the oil discharged from the electric oil pump increases.

2. The variable valve system according to claim 1, wherein the computer obtains an oil temperature base value based on a temperature of a coolant for the internal combustion engine, calculates a correction value by using a parameter related to a heat balance of the oil supplied to the valve characteristic changing mechanism, and uses a value obtained by correcting the oil temperature base value by using the correction value as the temperature of the oil.

3. The variable valve system according to claim 2, wherein the computer calculates the correction value by using at least one parameter which is selected from parameters depending on an operating state of the internal combustion engine.

4. The variable valve system according to claim 3, wherein, when starting of the internal combustion engine is initiated, the computer uses, as the parameter, a time that elapses from when stopping of the internal combustion engine is completed until when starting of the internal combustion engine is initiated.

5. The variable valve system according to claim 4, wherein, when starting of the internal combustion engine is initiated, the computer calculates the temperature of the oil by correcting the oil temperature base value based on the time that elapses from when stopping of the internal combustion engine is completed until when starting of the internal combustion engine is initiated, the time being used as the parameter, such that a value obtained by correction is higher than the oil temperature base value.

6. The variable valve system according to claim 3, wherein, during a period from when cold starting of the internal combustion engine is initiated until when warming of the internal combustion engine is completed, the computer uses, as the parameter, at least one of a time that has elapsed since starting of the internal combustion engine is initiated, and an accumulated value which indicates a total amount of air that has been taken in the internal combustion engine since starting of the internal combustion engine is initiated.

7. The variable valve system according to claim 6, wherein, during the period from when cold starting of the internal combustion engine is initiated until when warning of the internal combustion engine is completed, the computer calculates the temperature of the oil by correcting the oil temperature base value based on at least one of the time that has elapsed since starting of the internal combustion engine is initiated, and the accumulated value that indicates the total amount of air that has been taken in the internal combustion engine since starting of the internal combustion engine is initiated, at least one of the time and the accumulated value being used as the parameter, such that a value obtained by correction is lower than the oil temperature base value.

8. The variable valve system according to claim 3, wherein, when a vehicle provided with the internal combustion engine is running at high load and high speed, the computer uses at least one of an engine load, a time that has elapsed since the vehicle starts running at high load and high speed, and an accumulated value which indicates a total amount of air that has been taken in the internal combustion engine since the vehicle starts running at high load and high speed, as a parameter related to a heat balance of the oil; uses at least one of an engine rotational speed and a vehicle speed as a parameter related to an amount of heat that is removed from the coolant for the internal combustion engine; and calculates the correction value based on the parameter related to the heat balance of the oil and the parameter related to the amount of heat removed from the coolant.

9. The variable valve system according to claim 1, wherein the electric oil pump is driven independently of the operation of the internal combustion engine, and the electric oil pump compensates for a shortfall in the hydraulic pressure of the oil discharged from the mechanical oil pump to the valve characteristic changing mechanism.

10. The variable valve system according to claim 1, wherein the computer increases a drive duty ratio of the electric oil pump such that the hydraulic pressure of the oil discharged from the electric oil pump increases, as the temperature of the oil supplied to the valve characteristic changing mechanism increases.

11. The variable valve system according to claim 1, wherein, the computer drives the electric oil pump such that, when an engine rotational speed becomes lower than a predetermined value that is equal to or lower than an idle speed during an idling operation, the hydraulic pressure of the oil discharged from the electric oil pump decreases.

12. The variable valve system according to claim 1, further comprising:

an accumulator which is connected to an oil supply passage that is connected to the valve characteristic changing mechanism.

13. The variable valve system according to claim 1, wherein the computer restricts a change in a driving state of the electric oil pump, when a driving state of the valve characteristic changing mechanism changes rapidly.

14. The variable valve system according to claim 13, wherein the computer increases a drive duty ratio of the electric oil pump as the temperature of the oil supplied to the valve characteristic changing mechanism increases, and the computer restricts an amount of change in the drive duty ratio when the amount of change in the drive duty ratio is equal to or larger than a predetermined amount.

15. The variable valve system according to claim 1, wherein the engine is provided with a lift amount changing mechanism which changes a maximum lift amount of the engine valve, and the valve characteristic changing mechanism is a valve timing changing mechanism which changes valve timing of the engine valve.

16. A variable valve system of an internal combustion engine, comprising:

a mechanical oil pump which is driven by an operation of an internal combustion engine;

a valve characteristic changing mechanism which is driven by a hydraulic pressure of oil discharged from the mechanical oil pump, thereby changing a valve characteristic of an engine valve;

an electric oil pump which discharges oil for driving the valve characteristic changing mechanism; and a computer which controls the valve characteristic changing mechanism such that the valve characteristic of the engine valve is adjusted to a target characteristic that is set so as to be variable based on an engine operating state;

wherein the computer drives the electric oil pump such that, as a viscosity of the oil supplied to the valve characteristic changing mechanism is reduced, a hydraulic pressure of the oil discharged from the electric oil pump increases.

17. A control method for a variable valve system of an internal combustion engine, comprising the following steps of:

providing a mechanical oil pump which is driven by an operation of an internal combustion engine; a valve characteristic changing mechanism which is driven by a hydraulic pressure of oil discharged from the mechanical oil pump, thereby changing a valve characteristic of an engine valve; and an electric oil pump which discharges oil for driving the valve characteristic changing mechanism;

driving the electric oil pump such that, as a temperature of the oil supplied to the valve characteristic changing mechanism increases, or as a viscosity of the oil supplied to the valve characteristic changing mechanism is reduced, a hydraulic pressure of the oil discharged from the electric oil pump increases; and providing a computer to control the valve characteristic changing mechanism such that the valve characteristic of the engine valve is adjusted to a target characteristic that is set so as to be variable based on an engine operating state.

* * * * *